US006632577B2

(12) United States Patent
Akashi et al.

(10) Patent No.: US 6,632,577 B2
(45) **Date of Patent: *Oct. 14, 2003**

(54) IMAGE FORMING METHOD

(75) Inventors: Yasutaka Akashi, Yokohama (JP); Yushi Mikuriya, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/524,166

(22) Filed: Aug. 30, 1995

(65) Prior Publication Data

US 2002/0106575 A1 Aug. 8, 2002

Related U.S. Application Data

(63) Continuation of application No. 08/136,092, filed on Oct. 14, 1993, now abandoned.

(30) Foreign Application Priority Data

Oct. 15, 1992 (JP) ..... 4-277236

(51) Int. Cl.[7] ..... G03G 13/08

(52) U.S. Cl. ..... 430/125; 430/109.3; 430/109.4; 430/109.1; 430/111.4; 430/108.1; 430/108.8

(58) Field of Search ..... 430/124, 109, 430/904, 125, 108.8, 108.1, 109.3, 109.4, 109.1, 111.4; 355/298

(56) References Cited

U.S. PATENT DOCUMENTS

| | | | | |
|---|---|---|---|---|
| 2,297,691 A | | 10/1942 | Carlson | |
| 3,941,898 A | | 3/1976 | Sadamatsu et al. | 427/18 |
| 4,054,381 A | * | 10/1977 | Bernhard | 355/298 |
| 4,578,338 A | | 3/1986 | Gruber et al. | 430/120 |
| 4,792,513 A | * | 12/1988 | Gruber et al. | 430/109 |
| 4,917,982 A | | 4/1990 | Tomono et al. | 430/99 |
| 4,921,771 A | | 5/1990 | Tomono et al. | 430/110 |
| 4,988,598 A | | 1/1991 | Tomono et al. | 430/99 |
| 4,990,424 A | | 2/1991 | Van Dusen et al. | 430/106.6 |
| 4,997,739 A | | 3/1991 | Tomono et al. | 430/110 |
| 5,004,666 A | | 4/1991 | Tomono et al. | 439/110 |
| 5,023,158 A | | 6/1991 | Tomono et al. | 430/99 |
| 5,135,833 A | * | 8/1992 | Matsunaga et al. | 430/904 |
| 5,200,788 A | * | 4/1993 | Thayer | 355/298 |
| 5,268,248 A | | 12/1993 | Tanikawa et al. | 430/106 |
| 5,364,722 A | | 11/1994 | Tanikawa et al. | 430/10 |

FOREIGN PATENT DOCUMENTS

| | | | |
|---|---|---|---|
| EP | 0531990 A1 | 3/1993 | |
| JP | 42 23910 | 11/1967 | |
| JP | 43 24748 | 10/1968 | |
| JP | 51 23354 | 7/1976 | G03G/9/08 |
| JP | 52 3304 | 1/1977 | G03G/9/08 |
| JP | 52 3305 | 1/1977 | |
| JP | 55-6895 | 2/1980 | |
| JP | 56-16144 | 2/1981 | |
| JP | 57 52574 | 11/1982 | G03G/9/08 |
| JP | 58 86558 | 5/1983 | G03G/9/08 |
| JP | 60 166958 | 8/1985 | G03G/9/08 |
| JP | 60 217366 | 10/1985 | G03G/9/08 |
| JP | 60 252360 | 12/1985 | G03G/9/08 |
| JP | 60 252361 | 12/1985 | G03G/9/08 |
| JP | 61 94062 | 5/1986 | G03G/9/08 |
| JP | 61 138259 | 6/1986 | G03G/9/08 |
| JP | 61 273554 | 12/1986 | G03G/9/08 |
| JP | 62 14166 | 1/1987 | G03G/9/08 |
| JP | 63 220172 | 9/1988 | G03G/9/08 |
| JP | 63 223662 | 9/1988 | G03G/9/08 |
| JP | 1-109359 | 4/1989 | G03G/9/08 |
| JP | 1-172843 | 7/1989 | G03G/9/08 |
| JP | 1-172844 | 7/1989 | G03G/9/08 |
| JP | 1-214874 | 7/1989 | G03G/9/08 |
| JP | 2-79860 | 3/1990 | G03G/9/087 |
| JP | 2-110572 | 4/1990 | G03G/9/08 |
| JP | 3-50559 | 3/1991 | G03G/9/08 |

OTHER PUBLICATIONS

Diamond, Arthur S. (editor) Handbook of Imaging Materials. New York: Marcel–Dekker, Inc. pp. 160–164.*
English translation of JP 63–220172, Sep. 1988.*
English translation of JP 1–214874, Aug. 1989.*

* cited by examiner

*Primary Examiner*—Christopher Rodee
(74) *Attorney, Agent, or Firm*—Fitzpatrick, Cella, Harper & Scinto

(57) ABSTRACT

An image forming method including forming an electrostatic latent image on an electrostatic latent image bearing member; developing said electrostatic latent image employing a toner to form a toner image; transferring the toner image to a recording medium; cleaning the electrostatic latent image bearing member with a contact cleaner to collect untransferred toner as waste toner thereon and fixing the toner image transferred to the recording medium, wherein said waste toner after collection is reused in a subsequent developing step as a mixed toner comprising said collected waste toner and toner not yet used for developing the electrostatic latent image, wherein said toner comprises a binder resin, a colorant and a release agent, said binder resin having at least one peak in the region of a molecular weight from 2,000 to 50,000 and at least a peak or shoulder in the region of a molecular weight of not less than 100,000 in molecular weight distribution as measured by gel permeation chromatography, and said release agent having a methylene chain, a temperature of an endothermic peak in the range of 80° C. to 120° C. at the time of temperature rise in its DSC curve, an onset temperature of the endothermic peak in the range of 45° C. to 100° C., a weight average molecular weight (Mw) from 500 to 4,000, a number average molecular weight (Mn) from 500 to 1,300 and a value of Mw/Mn of not more than 3 in molecular weight distribution as measured by gel permeation chromatography.

25 Claims, 2 Drawing Sheets

IMAGE FORMING METHOD

This application is a continuation of application Ser. No 08/136,092, filed Oct. 14, 1993, now abandoned.

BACKGROUND OF THE INVENTION

1. Field of the invention

The present invention relates to an image forming method carried out by developing an electrostatic latent image to form a toner image and transferring the toner image to a recording medium, followed by fixing. More particularly, it relates to an image forming method in which untransferred toner having remained on an electrostatic latent image bearing member after transfer is collected by a cleaning means and again used in the development of electrostatic latent images.

2. Related Background Art

A number of methods as disclosed in U.S. Pat. No. 2,297,691, Japanese Patent Publications No. 42-23910 and No. 43-24748 and so forth are conventionally known for electrophotography. In general, copies are obtained by forming an electrostatic latent image on a photosensitive member by utilizing a photoconductive material and by various means, subsequently developing the latent image by the use of a toner, and transferring the toner image to a transfer medium such as paper if necessary, followed by fixing by the action of heat, pressure, heat-and-pressure or solvent vapor.

Various methods or apparatus have been developed in relation to the above final step, i.e., the step of fixing the toner image to a sheet such as paper. A method most commonly available at present is the pressure heating system making use of a heating roller.

The pressure heating system making use of a heating roller is a method of carrying out fixing by causing an image-receiving sheet to pass over a heating roller whose surface is formed of a material having a releasability to toner while a toner image surface of the former is brought into contact with the surface of the latter under application of a pressure. Since in this method the surface of the heating roller comes into contact with the toner image of the image-receiving sheet under application of a pressure, a very good thermal efficiency can be achieved when the toner image is melt-adhered onto the image-receiving sheet, so that fixing can be carried out rapidly. This method is therefore very effective in high-speed electrophotographic copying machines. In this method, however, since the surface of the heating roller comes into contact with the toner image in a molten state under application of a pressure, part of the toner image may sometimes adhere and transfer to the surface of the fixing roller, which may re-transfer to the subsequent image-receiving sheet to cause an offset phenomenon, resulting in a contamination of the image-receiving sheet. Thus, it is one of important requirements in the heating roller fixing method to cause no toner to adhere to the surface of the heat-fixing roller.

For the purpose of causing no toner to adhere to the surface of a fixing roller, it has been attempted, for example, to form the surface of a roller by the use of a material having a good releasability to the toner, such as silicone rubber or fluorine resin, and further covering the roller surface with a thin film of a fluid having a good releasability, such as silicone oil in order to prevent offset to its surface and to prevent roller surface fatigue. Although this method is very effective for preventing the toner offset, it requires a device for feeding an offset preventing fluid, and hence has the problem that a fixing assembly becomes complicated.

Moreover, under the influence of such a device, the machine inside may be contaminated because of the evaporation of silicone oil by heat. Accordingly, from the thought that no device for feeding silicone oil should be used and instead the offset preventing fluid should be fed from the interior of the toner at the time of heating, a method is proposed in which a release agent such as low-molecular weight polyethylene or low-molecular weight polypropylene is added in the toner. When such an additive is used in a large quantity to make its addition very effective, it causes filming on the photosensitive member or contaminates the surface of a carrier or a toner carrying member such as a sleeve. As a result, deterioration of images is caused and there are problems in practical use. Accordingly, the release agent is added in toner in an amount small enough not to cause deterioration of images, and a releasing oil is fed a little or a cleaning device for removing the toner having offsetted is used in combination. The cleaning unit is a device comprising a cleaning means making use of a wind-up type member such as a web.

It is also known to incorporate a wax into toner as a release agent. For example, Japanese Patent Applications Laid-open No. 52-3304, No. 52-3305 and No. 57-52574 disclose such techniques.

Japanese Patent Applications Laid-open No. 3-50559, No. 2-79860, No. 1-109359, No. 62-14166, No. 61-273554, No. 61-94062, No. 61-138259, No. 60-252361, No. 60-252360 and No. 60-217366 disclose techniques by which waxes are incorporated into toners.

The waxes are used to improve anti-offset properties of toner in low-temperature fixing or high-temperature fixing or to improve fixing performance in low-temperature fixing.

In practice, however, good high-temperature anti-offset properties have been achieved but no satisfactory low-temperature fixing performance results, or good low-temperature anti-offset properties and low-temperature fixing have been achieved but unsatisfactory high-temperature anti-offset properties result. Thus, good low-temperature anti-offset properties and good high-temperature anti-offset properties have not been simultaneously achieved.

Now, as other methods, various attempts are made on techniques to improve of binder resins.

For example, in order to prevent the offset of toner, a method is known in which the glass transition point (Tg) or molecular weight of a binder resin in a toner is made higher to improve melt elasticity of the toner. If, however, such a method is used to improve anti-offset properties, the fixing performance may become unsatisfactory to cause the problem that fixing performance in low-temperature fixing (i.e., low-temperature fixing performance) becomes poor which is required when high-speed copying machines are used or energy saving is intended.

On the other hand, in order to improve the fixing performance of a toner, the viscosity of the toner at the time of melting must be decreased to increase the area in which the toner adheres to a fixing substrate. For this reason, it is required to make the Tg or molecular weight of the binder resin lower.

Since the low-temperature fixing performance and the anti-offset properties conflict each other in one aspect, it is very difficult to make an improvement in toners that can simultaneously satisfy these functions.

As proposals to solve these problems, for example, Japanese Patent Publication No. 51-23354 discloses a toner comprising a vinyl polymer appropriately cross-linked by adding a cross-linking agent and a molecular weight modifier, and Japanese Patent Publication No. 55-6895 discloses a toner comprising an α,β-unsaturated ethylene monomer as a component unit and whose molecular weight distribution has been broadened so that the ratio of weight average molecular weight to number average molecular weight comes to be 3.5 to 40. Another proposal is made for a toner comprising a vinyl polymer in which a blended resin having specific Tg, molecular weight, gel content and so forth is used.

It is true that these toners proposed can achieve a broader fixing temperature range between lowest fixing temperature (the lowest temperature at which fixing can be carried out) and offset temperature (the temperature at which the offset begins to occur) than a toner comprising a single-component resin having a narrow molecular weight distribution, but it is difficult to make the fixing temperature sufficiently low when a satisfactory offset preventing performance is imparted. On the contrary, there is a problem that the offset preventing performance becomes unsatisfactory when importance is attached to low-temperature fixing performance.

For example, a toner comprising a binder resin comprised of a low-molecular weight polymer and a high-molecular weight polymer is proposed in Japanese Patent Application Laid-open No. 56-158340. In practice, it is difficult for this binder resin to be incorporated with a cross-linking component, and hence it is necessary to make the molecular weight of the high-molecular weight polymer larger or to increase the proportion of the high-molecular weight polymer in order to improve the anti-offset properties. This aims at a remarkable decrease in grindability of resin compositions, and it is difficult to obtain satisfactory toners in practical use. As another proposal regarding a toner comprising a blend of a low-molecular weight polymer and a cross-linked polymer, Japanese Patent Application Laid-open No. 58-86558 discloses a toner having a resin component mainly comprised of a low-molecular weight polymer and an insoluble infusible high-molecular weight polymer. This method is considered capable of improving the anti-offset properties of toners and the grindability of resin compositions. However, the low-molecular weight polymer has a value of weight average molecular weight/number average molecular weight (Mw/Mn) of as small as 3.5 and the insoluble infusible high-molecular weight polymer is in an amount of as large as 40 to 90% by weight, and hence it is difficult to satisfy both the anti-offset properties of toners and the grindability of resin compositions at a high performance. In practice, it is very difficult to produce a toner that can satisfy both the fixing performance and the anti-offset properties unless a fixing machine having the device for feeding an offset preventing fluid is used. Moreover, in the course of heat kneading when the toner is produced, the melt viscosity greatly increases with an increase in the insoluble infusible high-molecular weight polymer, and hence the heat kneading must be carried out at a much higher temperature than usual, consequently bringing about a problem of a lowering of toner performance because of thermal decomposition of additives.

Japanese Patent Application Laid-open No. 60-166958 discloses a toner comprising a resin composition having a number average molecular weight of from 500 to 1,500, obtained by polymerization carried out in the presence of a low-molecular weight α-methylstyrene polymer.

In particular, this publication discloses that the number average molecular weight (Mn) is preferably in the range of from 9,000 to 30,000. Making the Mn larger in order to improve anti-offset properties brings about problems in practical use, on the fixing performance and the grindability required when the toner is produced. Hence, it is difficult to satisfy both the anti-offset properties and the grindability of resin compositions at a high performance. Thus, the toner showing a poor grindability when the toner is produced is not preferable since it may cause a decrease in production efficiency of the toner produced, and also tends to cause inclusion of coarse toner because of properties of the toner, often resulting in occurrence of black spots around images.

Japanese Patent Applications Laid-open No. 56-16144 discloses a toner containing a binder resin component having at least one peak value in each of the regions of a molecular weight of $10^3$ to $8\times10^4$ and a molecular weight of $10^5$ to $2\times10^6$ This toner has superiority in the grindability of binder resin components, anti-offset properties of toner, fixing performance, prevention of filming or melt-adhesion to photosensitive members, and developing performance. It is sought to further improve the anti-offset properties and fixing performance in the toner. In particular, it is difficult for this resin to cope with the recent severe demand while further improving the fixing performance and also while maintaining or improving other various performances.

Thus, it is very difficult to achieve at a high performance both the performance concerning the fixing of toner (the low-temperature fixing performance and anti-offset properties) and the grindability in the production of toner. In particular, the grindability in the production of toner is a factor important to the recent trend where toners are made to have smaller particle diameters in answer to demands for making the quality level of copied images higher, making the resolution thereof higher and achieving higher fine-line reproducibility. The step of pulverization requires a very large energy, and hence the improvement in grindability is important also in view of energy saving. The phenomenon of melt-adhesion of toner to the inner walls of a pulverizing apparatus tends to occur in toners having a good fixing performance, sometimes resulting in a poor pulverization efficiency.

In the process of copying, there is a step in which the toner having remained on a photosensitive member after transfer is removed by cleaning. Nowadays, taking account of making apparatus more small-sized, light-weight and reliable, it is prevalent to carry out cleaning by means of a blade (i.e., blade cleaning). As photosensitive members are made to have a longer lifetime, drum-type photosensitive members are made to have a smaller diameter and systems are made more high-speed, requirements on toners becomes severer in respect of melt-adhesion resistance and filming resistance to photosensitive members. In particular, amorphous silicon photosensitive members having been recently put into practical use have a very high durability. OPC (organic photosensitive members) are also enjoying a longer lifetime. Hence, the performances required on toners have become higher.

To make apparatus small-sized, components must be well disposed in an narrow place. This is accompanied by a decrease in space through which cooling air flows and also a very near approach of a fixing assembly or a heat source of an exposure system to a toner hopper or a cleaner, so that toner is laid open to a high-temperature atmosphere. For this reason, none of toners can be now put into practical use unless they have much superior blocking resistance.

As a means for overcoming the problems discussed above, the present applicant has disclosed in Japanese Patent Application Laid-open No. 63-223662 a special resin to which a low-molecular weight resin is added during suspension polymerization. Even this method, however, can not achieve a satisfactory fixing performance when used in high-speed copying machines that can take copies on 50 or more A4-size sheets per minute. There has been found another problem that fixed images tend to be stained because of flow-out of toner from a cleaning member coming into contact with a fixing roller.

In low-speed or medium-speed copying machines, the quantity of offset matter on the fixing roller becomes reasonably large with an increase in the quantity of paper feed even though offset quantity per sheet is very small, which can be a cause of troubles of the fixing assembly. In order to remove this small quantity of offset matter, a fixing-step cleaning member such as a cleaning roller or web made of silicone rubber is fitted to the fixing roller in contact therewith. Conventional binder resins for toners are designed mainly with the intention of low-temperature fixing performance and anti-offset properties, and are not designed so that a high melt viscosity can be maintained even against a high temperature exceeding 200° C. Hence, the toner substance having adhered to the fixing-step cleaning member comes to have a low melt viscosity as it stands there for a long time at a temperature set for the fixing roller. In addition, when the temperature of the fixing roller overshoots the temperature set for the fixing roller when a copying machine is switched on, the fixing roller may come to have a temperature higher than 200° C., resulting in an extreme decrease in melt viscosity of the toner having adhered, which toner is again transferred to the fixing roller to cause contamination of recording mediums.

Japanese Patent Applications Laid-open No. 1-172843 and No. 1-172844 disclose a toner having peaks at a molecular weight of $3\times10^3$ to $5\times10^3$ and a molecular weight of $1.5\times10^5$ to $2.0\times10^6$, and having 40 to 60% of peak area in the region of a molecular weight of $1.5\times10^5$ to $2.0\times10^6$ or having 1 to 10% of gel content. However, it is hard to say that the toner has also completely well coped with the anti-offset properties and fixing performance, and the toner is sought to be further improved.

As discussed above, various performances such as developability, low-temperature fixing performance, anti-offset properties, blocking resistance, filming resistance and grindability (of resin compositions) required for toners often conflict with each other. In recent years, it is more sought to satisfy them altogether at high performances.

In the transfer step, the toner on a photosensitive member (an electrostatic latent image bearing member) is not transferred in its entirety, and about 10 to 20% by weight of the toner remains on the photosensitive member. The toner thus having remained on the photosensitive member (i.e., untransferred toner) is collected through a cleaning step and discharged out of the system as what is called a waste toner, which has not been reused. When such waste toner is discarded as waste (waste plastic material), there is a possibility of causing environmental pollution. Accordingly, nowadays, the waste toner is reused. That is, it is being widely studied to reuse the waste toner. If it becomes possible to reuse the waste toner, there can be advantages such that toners can be used effectively, machine space can be simplified and machines can be made compact.

Hitherto, however, when the waste toner is again used in the developing step, there have been various adverse effects such that reflection image density decreases, ground fog and reversal fog increase and toner scatter occurs.

As performances of the toner applied to such reusable systems, the toner is required not only to have the developability, low-temperature fixing performance, anti-offset properties, blocking resistance, filming resistance and grindability stated above, but also to have the properties such that it is tough to mechanical stress, has a good durability or running performance and shows a good transport performance when the waste toner is fed to the developing step.

To cope with these requirements, a variety of toners have been hitherto invented. For example, Japanese Patent Application Laid-open No. 63-220172 discloses a toner in which a non-linear polyester is used in a binder resin and a low-molecular weight polyolefin is incorporated therewith; Japanese Patent Application Laid-open No. 1-214874, a toner in which a specific polyester resin containing an aliphatic diol is used in a binder resin; and also Japanese Patent Application Laid-open No. 2-110572, a toner in which a metal-crosslinked styrene/acrylate copolymer is used in a binder resin and to which a polyolefin is added in a large quantity. These toners invented, however, all have a high possibility that some difficulties occur, e.g., the anti-offset properties become poor.

In recent years, there is an increasing demand for copying machines. With such demand, user's demands for copying machines are varying. Under such circumstances, machine bodies are persistently required to be made compact particularly in the field of low-speed or medium-speed copying machines.

In recent years, not only high-speed copying machines but also such low-speed or medium-speed copying machines are sought to be made more highly durable and more highly reliable, and it is attempted to increase copy volume while maintaining always good image characteristics. Thus, with an increase in the copy volume, the quantity of the toner consumed increases, concurrently resulting in an increase in the quantity of the toner untransferred (i.e., waste toner). Hitherto, as previously mentioned, the untransferred toner is scraped off by a cleaning means such as a cleaning blade, delivered to a waste toner box and accumulated there and discharged out of the system. Thus, the waste toner has not been reused. The reason therefor is that the reuse of the waster toner has been accompanied by difficulties such that reflection image density decreases, ground fog and reversal fog increase, and toner scatter occurs. However, if it becomes possible to reuse the waste toner, not only toners can be used effectively, but also many advantages can be expected such that machines can be made compact since the waste toner box that has hitherto held a large volume in a machine body becomes unnecessary.

As discussed above, the performances required for toners often conflictory to each other. In recent years, also in the case when the waste toner is reused, it is more sought to satisfy them altogether at high performances.

SUMMARY OF THE INVENTION

An object of the present invention is to provide an image forming method that has solved the problems discussed above, that is, an image forming method employing a recycle system in which the untransferred toner is reused.

Another object of the present invention is to provide an image forming method that can obtain always sharp images without undergoing any mechanical damage even when copies are continuously taken while recycling the untransferred toner.

Still another object of the present invention is to provide an image forming method that can maintain an always high reflection image density and may cause no ground fog or toner scatter even when the untransferred toner is recycled.

A further object of the present invention is to provide an image forming method making use of a toner suited for a heat-roll fixing system in which no oil is applied.

A still further object of the present invention is to provide an image forming method making use of a toner that can achieve low-temperature fixing and has superior anti-offset properties.

A still further object of the present invention is to provide an image forming method making use of a toner that can achieve low-temperature fixing and may cause neither melt-adhesion nor filming to photosensitive members even in a high-speed system or during its use over a long period of time.

A still further object of the present invention is to provide an image forming method making use of a toner that can achieve low-temperature fixing, has a superior blocking resistance, and can also be used in a high-temperature environment in copying machines, in particular, small-sized machines.

A still further object of the present invention is to provide an image forming method making use of a toner that may cause less generation of coarse powder, because of a good grindability, and hence may cause less black spots around images and can form stable good developed images.

A still further object of the present invention is to provide an image forming method making use of a toner suited for a cleaning system employing a blade.

The present invention provides an image forming method comprising;

forming a toner image by developing through a developing means an electrostatic latent image formed on an electrostatic latent image bearing member;

said developing means holding a toner; said toner comprising a binder resin, a colorant and a release agent; said binder resin having at least one peak in the region of a molecular weight of from 2,000 to 50,000 and at least a peak or a shoulder in the region of a molecular weight of not less than 100,000, in molecular weight distribution as measured by gel permeation chromatography (GPC); and said release agent having a methylene chain;

transferring the toner image formed on the electrostatic latent image bearing member, to a recording medium;

cleaning the electrostatic latent image bearing member from which the toner image has been transferred to the transfer medium, to collect untransferred toner remaining on the electrostatic latent image bearing member;

feeding the toner collected, to said developing means so as to be again held in the developing means and used to form a toner image on the electrostatic latent image bearing member; and fixing the toner image transferred to the recording medium, to the recording medium through a fixing means.

DESCRIPTION OF THE PREFERRED EMBODIMENTS

Figure 1:
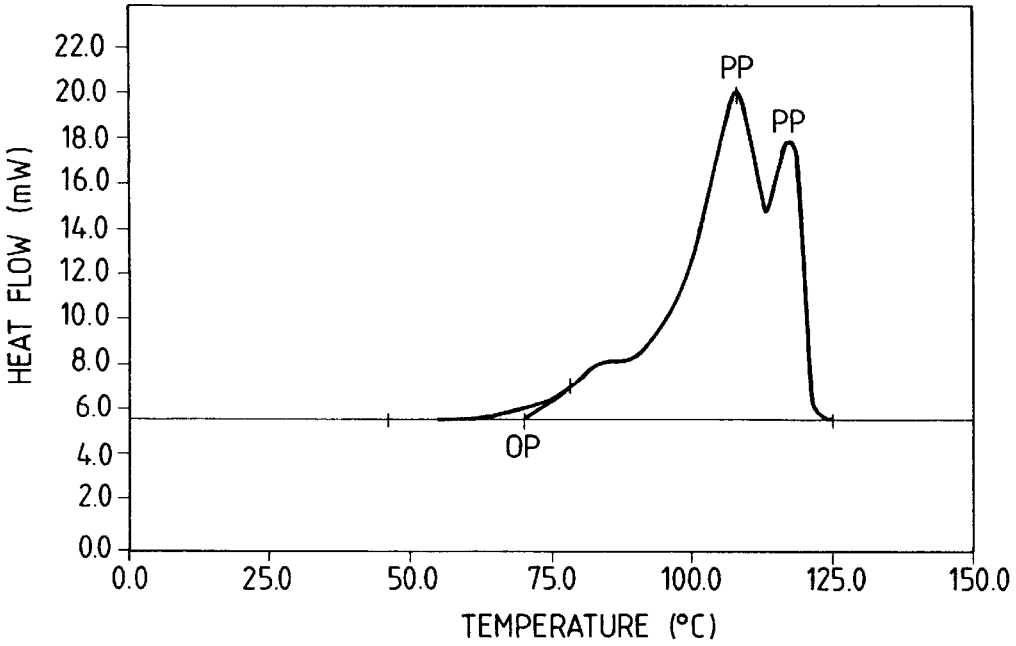
FIG. 1 is a graph to show endothermic peaks of a DSC curve at the time of temperature rise of a release agent.

To examine the cause of the difficulties such as the decrease in reflection image density, the increase in ground fog and reversal fog and the occurrence of toner scatter that occur when the waste toner is reused in a developing system, the present inventors collected toner on developing sleeves arbitrarily at the time of start of copying and thereafter, and made various studies. As a result, changes in shape of toner particles were found before and after the time when the above difficulties began to occur.

More specifically, observation using a scanning electron microscope (SEM) revealed that particles whose surfaces came off and broken particles were present in a large number in the toner having caused the difficulties, i.e., the waste toner.

They examined the reasons therefor and found that the untransferred toner (the waste toner) is greatly affected by a mechanical impact applied when in a cleaner it is scraped off from the surface of a photosensitive member through a cleaning means such as a cleaning blade or it is transported to the developing step by means of a transport screw.

From the foregoing, performances required for toners in the system in which the waste toner is reused can be given as follows:

To have a good developing performance, a good low-temperature fixing performance and good anti-offset properties;

to have a good blocking resistance and a good filming resistance; and to have a good grindability;

which are well known performances required for toners, and in addition to these;

to have a toughness to mechanical impact and a good durability or running performance; and to have a good performance when transported to the developing step;

which are performances peculiar to the reuse of waste toner.

The present inventors made extensive studies on any means for satisfying the above performances, and have discovered that the problems previously discussed can be settled by the image forming method of the present invention in which the toner used has at least a binder resin, a colorant and a release agent, where the binder resin has at least one peak in the region of a molecular weight of from 2,000 to 50,000 and at least a peak or a shoulder in the region of a molecular weight of not less than 100,000, in molecular weight distribution as measured by gel permeation chromatography (GPC), and the release agent has a methylene chain.

The binder resin used in the present invention is characterized by having at least one peak in the region of a molecular weight of from 2,000 to 50,000, and preferably from, 4,000 to 40,000, and at least a peak or a shoulder in the region of a molecular weight of not less than 100,000, and preferably not less than 150,000, in molecular weight distribution as measured by gel permeation chromatography (GPC).

If the binder resin has no peak value in the region of a molecular weight of from 2,000 to 50,000 and has a molecular weight of less than 2,000 in its peak value, the resulting toner may have extremely poor anti-offset properties, wind-around performance to fixing rollers and filming resistance to photosensitive members, may also cause the problem of blocking, and still also tend to undergo mechanical damage during the recycling of the toner. If the binder resin has a peak value at a molecular weight more than 50,000, the resulting toner has a higher fixing temperature and a narrower fixing temperature region, and also has a poor grindability, causing a decrease in production efficiency. If the binder resin has no peak or shoulder in the region of a molecular weight of not less than 100,000, the resulting toner tends to undergo mechanical shear force, not only tending to cause a break but also often causing difficulties such as offset and blocking.

In the present invention, the molecular weight distribution in the chromatogram obtained by GPC (gel permeation chromatography) of tetrahydrofuran(THF)-soluble components of the binder resin of the toner is measured under the following conditions, using THF as a solvent.

A sample for measurement is prepared in the following way.

A sample is mixed with THF in a concentration of from about 0.5 to about 5 mg/ml (e.g., about 5 mg/ml), and the mixture is left to stand for several hours (e.g., for 5 to 6 hours), followed by thorough shaking such that the sample is well mixed with the THF (until coelescent matters of the sample has disappeared), which is further left to stand for at least 12 hours (e.g., for 24 hours). At this time, the sample is left to stand in THF for at least 24 hours after the mixing of the sample with the THF is started until the mixture has been left to stand. Thereafter, the solution having been passed through a sample-treating filters, (pore size: 0.45 to 0.5 $\mu$m; for example, MAISHORI DISK H-25-5, available from Toso Co., Ltd. or EKICHRO DISK 25CR, available from German Science Japan, Ltd., can be utilized), is used as the sample for GPC. The sample is adjusted to have resin components in a concentration of from 0.5 to 5 mg/ml.

In the binder resin contained in the toner used in the present invention, the resin component that remains as an insoluble component in the above filtering should preferably be in an amount of not more than 10% by weight, and more preferably not more than 5% by weight. This is preferable for making the present invention effective.

In a GPC measuring apparatus, columns are stabilized in a heat chamber of 40° C. To the columns kept at this temperature, THF as a solvent is flowed at a flow rate of 1 ml per minute, and about 100 $\mu$l of THF sample solution is injected thereinto in order to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko KK., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H ($H_{XL}$) and TSK guard column, available from Toso Co., Ltd.

In the measurement on the GPC chromatogram, the measurement for the high-molecular weight side is usually started from a point at which the curve of the chromatogram begins to rise from its base line and the measurement for the low-molecular weight side is made up to a molecular weight of about 400 g.

With respect to (i) the molecular weight distribution measured by GPC of the binder resin of a toner in the case where the toner is produced by melt kneading using plural kinds of binder resins or (ii) the molecular weight distribution measured by GPC of the binder resin of a toner in the case where the molecular weight distribution greatly changes before and after the toner is formed, as in the case where the binder resin and the organic metal compound are metal-crosslinked when toner materials are formed into the toner by melt kneading in the presence of a metal-crosslinkable organic metal compound or in the case where molecular chains of a large quantity of THF-insoluble components (gel components) are cut when toner materials are formed into the toner by melt kneading, the molecular weight distribution of the binder resin can be measured on the basis of the molecular weight distribution measured by GPC of THF-soluble components of the toner.

The binder resin used in the present invention may include vinyl resins, polyesters, polyurethanes, epoxy resins, polyamides, polyvinyl butyral, rosins, modified rosins, terpene resins, phenol resins, aliphatic or aromatic hydrocarbon resins and aromatic petroleum resins, any of which may be used so long as the present invention is not adversely affected. In particular, vinyl resins or polyester resins are preferably used.

The binder resin used in the present invention may be a copolymer such as a block copolymer or a grafted product.

As methods for synthesizing the vinyl resins, various polymerization processes can be used.

In bulk polymerization, low-molecular weight polymers can be obtained by carrying out the polymerization at a high temperature and accelerating the rate of termination reaction, but there is a problem that the reaction can be controlled only with difficulty. In solution polymerization, low-molecular weight polymers or copolymers can be readily obtained under mild conditions by utilizing differences in chain transfer of radicals attributable to a solvent or by controlling the amount of a polymerization initiator used or the reaction temperature. Thus, the latter is preferred as a polymerization process for obtaining a low-molecular weight polymer or copolymer in the resin composition used in the present invention.

As the solvent used in the solution polymerization, xylene, toluene, cumene, cellosolve acetate, isopropyl alcohol or benzene may be used. In the case of a styrene monomer mixture, xylene, toluene or cumene is preferred. The solvent may be appropriately selected depending on the polymer produced by polymerization.

The polymerization initiator may include di-tert-butyl peroxide, tert-butyl peroxybenzoate, benzoyl peroxide, 2,2'-azobisisobutyronitrile and 2,2'-azobis(2,4-dimethylvaleronitrile. The polymerization initiator may be used in a concentration of not less than 0.05 part by weight, and preferably from 0.1 to 15 parts by weight, based on 100 parts by weight of the monomer.

The reaction temperature may vary depending on the solvent and polymerization initiator used or the polymer to be produced by polymerization, and should preferably be in the range of from 70° C. to 230° C. In the solution polymerization, the reaction may preferably be carried out using monomers in an amount of from 30 parts by weight to 400 parts by weight based on 100 parts by weight of the solvent. At the time the polymerization is completed, other polymer or copolymer may preferably be further mixed in the solution. In that instance, several kinds of polymers or copolymers can be well mixed.

As a polymerization process for obtaining the high-molecular weight component of a high cross-link region, emulsion polymerization or suspension polymerization are preferred.

Of these, the emulsion polymerization is a process in which monomers almost insoluble in water are dispersed with an emulsifying agent into minute particles and polymerization is carried out using a water-soluble polymerization initiator. In this process, the heat of reaction can be controlled with ease and, since the phase in which the polymerization is carried out (an oily phase comprised of a polymer and monomers) and the aqueous phase are separate from each other, the rate of termination reaction is low and consequently the rate of polymerization is high, so that a product with a high degree of polymerization can be obtained. Moreover, since the process of polymerization is relatively simple and also since the polymerization product is in the form of fine particles, the product can be readily mixed with a colorant and a charge control agent as well as other additives. For this reason, the emulsion polymerization is advantageous as a process for producing binder resins for toners, compared with other processes.

However, because of the emulsifying agent added, the resin produced tends to become impure, and hence an operation such as salting-out is required in order to extract the resin. Thus, the suspension polymerization is preferred since it is a simple and easy process.

In the suspension polymerization, a monomer mixture containing a low-molecular weight polymer or copolymer in a suspended state is polymerized in the presence of a cross-linking agent, whereby the resulting resin composition can be regularly in the form of pearls, and products including a low-molecular weight polymer or copolymer and a medium- or high-molecular weight polymer or copolymer containing a cross-linked region component can also be obtained in a uniformly mixed preferable state.

In the suspension polymerization, the reaction should be carried out using monomers in an amount of not more than 100 parts by weight, and preferably from 10 to 90 parts by weight, based on 100 parts by weight of water or a water-based solvent. As a usable dispersant, polyvinyl alcohol, a polyvinyl alcohol partially saponified product, or calcium phosphate may be used, used in variable amount, variable depending on the amount of monomers based on the water-based solvent, usually of from 0.05 to 1 part by weight based on 100 parts by weight of the water-based solvent. It is suitable for the polymerization to be carried out at a temperature of from 50 to 95° C., which should be appropriately selected according to the initiator used and the intended polymer. The polymerization initiator may be of any type so long as it is insoluble or slightly soluble in water. For example, benzoyl peroxide or tert-butyl peroxyhexanoate is used in an amount of from 0.5 to 10 parts by weight based on 100 parts by weight of the monomer.

The binder resin composition used in the present invention can be obtained, for example, by the method as shown below.

The method can be i) a method in which a polymer or copolymer (A) having a main peak in the region of a molecular weight of from 2,000 to 50,000 is formed by the application of solution polymerization, bulk polymerization, suspension polymerization, emulsion polymerization, block copolymerization or grafting, and subsequently the polymer or copolymer (A) is dissolved in a polymerizable monomer mixture, followed by suspension polymerization to obtain a resin composition having the desired molecular weight distribution, or ii) a method in which a polymer or copolymer (B) obtained by solution polymerization, bulk polymerization, suspension polymerization or emulsion polymerization and mainly composed of a component having a molecular weight of not less than 100,000 is blended with the polymer or copolymer (A) in a solvent when solution polymerization is completed. Either method may be used.

Monomers of the vinyl resin used in the present invention may include the following. They can be exemplified by styrene, and styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octystyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; methacrylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in combination of two or more kinds.

Of these, monomers may preferably be used in such a combination that may give a styrene copolymer, a styrene-acrylic copolymer or a styrene-methacrylic copolymer.

The binder resin used in the present invention may contain an acid component. Monomers containing the acid component may include, for example, unsaturated dibasic acids such as maleic acid, citraconic acid, itaconic arid, alkenylsuccinic acids, fumaric acid and mesaconic acid; unsaturated dibasic acid anhydrides such as maleic anhydride, citraconic anhydride, itaconic anhydride and alkenylsuccinic anhydrides; unsaturated dibasic acid half esters such as a maleic acid methyl half ester, a maleic acid ethyl half ester, a maleic acid butyl half ester (e.g., mono-n-butyl maleate), a citraconic acid methyl half ester, a citraconic acid ethyl half ester, a citraconic acid butyl half ester, an itaconic acid methyl half ester, an alkenylsuccinic acid methyl half ester, a fumaric acid methyl half ester and a mesaconic acid methyl half ester; and unsaturated dibasic; acid diesters such as dimethylmaleate and dimethylfumarate.

They may further include α,β-unsaturated acids such as acrylic acid, methacrylic acid, crotonic acid and cinnamic acid; α,β-unsaturated acid anhydrides such as crotonic anhydride and cinnamic anhydride; anhydrides of the above α,β-unsaturated acids with lower fatty acids; alkenylmalonic acids, alkenylglutaric acids, alkenyladipic acids, and anhydrides and monoesters of these.

Of these, monoesters of α,β-unsaturated dibasic acids having a structure such as maleic acid, fumaric acid or succinic acid can be particularly preferably used.

A cross-linkable monomer may preferably be used particularly in order to prepare the high-molecular weight component with a molecular weight of not less than 100, 000, of the binder resin used in the present invention. As this cross-linkable monomer, a cross-linkable monomer mainly having at least two polymerizable double bonds is used.

To achieve the objects of the present invention, the binder resin used in the present invention may preferably be a polymer cross-linked with a cross-linkable monomer as exemplified by the following.

The cross-linkable monomer may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether bond, as exemplified by polyoxyethylene(2)-2,2-bis(4-hydroxyphenyl)propane diacrylate, polyoxythylene(4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.). A polyfunctional cross-linking agent may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.01 part by weight to 5 parts by weight, and more preferably from 0.03 part by weight to 3 parts by weight, based on 100 parts by weight of other monomer components.

Of these cross-linkable monomers, those preferably usable in resins for toners in view of fixing performance and anti-offset properties are aromatic divinyl compounds (in particular, divinyl benzene) and diacrylate compounds linked with a chain containing an aromatic group and an ether bond.

When a polyester resin is used as the binder resin of the toner used in the present invention, it is preferable to use a polyester resin comprising a condensation polymer formed of a polybasic component and a polyhydric alcohol component.

The polyester resin that can be used in the present invention has the composition as shown below.

As a dihydric alcohol component, it may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A).

Formula (A)

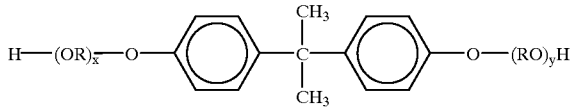

wherein R represents an ethylene group or a propylene group, x and y are each an integer of 0 or more, and an average value of x+y is 0 to 10; and a diol represented by the following Formula (B).

Formula (B)

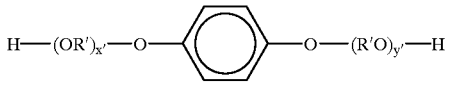

wherein R' represents —$CH_2CH_2$—,

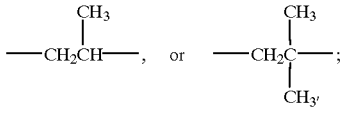

x' and y' are each an integer of 0 or more, and an average value of x'+y' is 0 to 10.

As a dibasic acid, it may include dicarboxylic acids and derivatives thereof as exemplified by benzene dicarboxylic acids such as phthalic acid, terephthalic acid, isophthalic acid and phthalic anhydride, or anhydrides or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids such as n-dodecenylsuccinic acid and n-dodecylsuccinic acid, or anhydrides or lower alkyl esters thereof; unsaturated dicarboxylic acids such as fumaric acid, maleic acid, citraconic acid and itaconic acid, or anhydrides or lower alkyl esters thereof.

A trihydric or higher alcohol component and a tribasic or higher acid component serving also as cross-linking components may also be used in combination.

The trihydric or higher, polyhydric alcohol component in the present invention may include trihydric or higher, polyhydric alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component may include polybasic carboxylic acids and derivatives thereof such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, Empol trimer acid, and anhydrides or lower alkyl esters of these; and a tetracarboxylic acid represented by the formula:

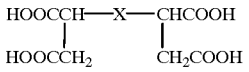

wherein X represents an alkylene group or alkenylene group having 5 to 30 carbon atoms having at least one side chain having 3 or more carbon atoms, and anhydrides or lower alkyl esters thereof.

In the polyester resin used in the present invention, the alcohol component should be used in an amount of from 40 to 60 mol %, and preferably from 45 to 55 mol %; and the acid component, from 60 to 40 mol %, and preferably from 55 to 45 mol %.

The trihydric or -basic or higher, polyhydric or -basic component should be in an amount of from 5 to 60 mol % of the whole components.

In the present invention, preferred alcohol components of the polyester resin are bisphenol derivatives represented by Formula (A) described above. Preferred acid components are phthalic acid, terephthalic acid, isophthalic acid or anhydrides thereof; succinic acid, n-dodecenylsuccinic acid or anhydrides thereof; dicarboxylic acids such as fumaric acid, maleic acid, and maleic anhydride; and tricarboxylic acids such as trimellitic acid or an anhydride thereof.

This is because the polyester resin obtained from any of these acids or alcohols shows sharp melting properties, has a good fixing performance as required of toners for heat-roller fixing, and has superior anti-offset properties.

The binder resin used in the present invention has at least one peak in the region of a molecular weight of from 2,000 to 50,000 and at least a peak or a shoulder in the region of a molecular weight of not less than 100,000, in molecular weight distribution as measured by gel permeation chromatography (GPC). The resin that can form the low-molecular weight component when such a binder resin is prepared should preferably be in a proportion of from 10 to 70% by weight, and more preferably from 20 to 60% by weight.

If the resin that can form the low-molecular weight component is in a proportion outside the above range, the functions respectively attributable to the low-molecular weight component in the region of a molecular weight of from 2,000 to 50,000 and the high-molecular weight component in the region of a molecular weight of not less than 100,000 can not be well exhibited.

The release agent used in the toner of the present invention must have a methylene chain. The release agent having a methylene chain contributes an improvement in lubricity, so that the toner may undergo a mechanical impact with difficulty, can have a superior durability and also may cause no decrease in fluidity even in the case of the waste toner to promise a superior performance when transported to the developing step. Hence, a good developing performance can be maintained in an always stable state. The methylene chain has preferably not less than 20 of carbon atoms, and more preferably not less than 30 of carbon atoms.

The release agent having a methylene chain as used in the present invention may include low-molecular weight polyolefin waxes such as low-molecular weight polyethylene, low-molecular weight polypropylene and a low-molecular weight polyethylene/polypropylene copolymer, microcrystalline wax, sazole wax, paraffin wax, alkyl alcohols, and alkylcarboxylic acids.

In the release agent described above, it is particularly preferred that, in the DSC curve measured using a differential scanning calorimeter, an endothermic peak at the time of temperature rise, i.e., the melting point, is preferably in the range of from 70 to 130° C., more preferably from 75 to 125° C., and still more preferably 80 to 120° C., and a difference between an end point onset temperature of the endothermic peak at the time of temperature rise and an onset temperature of the endothermic peak is preferably from 5 to 70° C., more preferably from 10 to 60° C., and still more preferably from 10 to 50° C.

In the present invention, when a plurality of endothermic peaks at the time of temperature rise are present, the highest endothermic peak is regarded as the melting point of the release agent. Since the release agent has the above melting point and the difference between an end point onset temperature of the endothermic peak at the time of temperature rise and an onset temperature of the endothermic peak, the release agent can have a high crystallinity, so that the release agent abruptly melts when the temperature approaches the fixing temperature region of the toner, and thus the release agent does not melt out at a temperature lower than that of the fixing temperature region. Hence, the toner can retain its hardness even if it is held image forming apparatus in the when a certain degree of heat is applied thereto, so that no additives such as fine silica powder mixed together with toner particles tend to be embedded in toner particles. This makes it hard for the fluidity of toner to decrease in the image forming method in which the waste toner is reused, and hence makes it possible to obtain good images with a good image quality and less fog and black spots around images from the initial stage and even after running.

If the release agent has a melting point lower than 70° C., no satisfactory high-temperature anti-offset properties can be achieved and also external additives tend to be embedded in the surfaces of toner particles, and the fluidity of toner tends to decrease. If it has a melting point higher than 130° C., satisfactory low-temperature anti-offset properties and low-temperature fixing performance can be achieved only with difficulty. The fixing performance and the anti-offset properties can be well balanced when the release agent has a melting point within the above temperature range.

If the difference between an end point onset temperature of the endothermic peak at the time of temperature rise in the DSC curve and an onset temperature of the endothermic peak is less than 5° C., a change in plasticity of the release agent may occur in a narrow temperature range to make high-temperature anti-offset properties and low-temperature anti-offset properties poor. If this difference between an end point onset temperature of the endothermic peak at the time of temperature rise and an onset temperature of the endothermic peak is more than 70° C., it becomes difficult to set the temperature range within which the release agent can effectively act, and it becomes difficult to impart preferable thermal properties to the toner, so that the fixing performance and the anti-offset properties are adversely affected.

In the release agent used in the present invention, it is also preferred that the onset temperature of the endothermic peak in the DSC curve is within the range of from 45° C. to 100° C. When it is within this range, the wax can satisfy the developing performance, blocking resistance and low-temperature fixing performance. If this onset temperature of the peak is lower than 45° C., the temperature at which the wax undergoes a change becomes excessively low and tends to make the toner have a poor blocking resistance or a poor developing performance at the time of temperature rise. If it is higher than 100° C., the temperature at which the wax undergoes a change becomes excessively high and tends to make it difficult to achieve a satisfactory fixing performance.

The DSC measurement in the present invention is carried out to measure the exchange of heat of the release agent to observe its behavior. Hence, in view of the principle of measurement, the measurement may preferably be carried out using a differential scanning calorimeter of a highly precise, inner heat input compensation type. For example, it is possible to use DSC-7, manufactured by Perkin Elmer Co.

The measurement is carried out according to ASTM D3418-82. The DSC curve used in the present invention is a DSC curve measured when temperature is once raised and dropped to previously take a history and thereafter the temperature is raised at a rate of temperature raise of 10° C./min. Each temperature is defined as follows:

Onset temperature of endothermic peak:

The temperature at a point where a tangent line of a curve at its point showing a first maximum differential value of the DSC curve at the time of temperature rise intersects the base line.

Peak temperature:

A peak top temperature at a peak which is highest from the base line.

Onset temperature at end point of endothermic peak:

The temperature at a point where a tangent line of a curve at its point showing a last minimum differential value of the DSC curve at the time of temperature rise intersects the base line.

The release agent usable in the present invention may include waxes comprised of i) a low-molecular-weight alkylene polymer obtained by radical polymerization of an alkylene under a high pressure or by polymerization thereof under a low pressure in the presence of a Ziegler catalyst, ii) an alkylene polymer obtained by thermal decomposition of a high-molecular-weight alkylene polymer or iii) a synthetic hydrocarbon obtained by hydrogenating the distillation residue of hydrocarbons prepared by the Arge process from a synthesis gas comprised of carbon monoxide and hydrogen, to which an antioxidant may be added. Those obtained through fractionation of hydrocarbon waxes by a fractional crystallization system utilizing press-sweating, solvent dewaxing or vacuum distillation are preferably used. The hydrocarbon, serving as a matrix, may include hydrocarbons synthesized by reacting carbon monoxide with hydrogen in the presence of a metal oxide type catalyst (usually formed of two or more kinds of catalysts), as exemplified by hydrocarbons having about several hundred carbon atoms (end products are formed by finally carrying out hydrogenation) obtained by the Synthol method, the Hydrocol process (making use of a fluidized catalyst bed) or the Arge process (making use of a fixed catalyst bed), which latter process provides waxy hydrocarbons in a large quantity; and hydrocarbons obtained by polymerizing alkylenes such as ethylene in the presence of a Ziegler catalyst; all of which are preferable as having less branches and being saturated long straight chain hydrocarbons. In particular, hydrocarbon waxes synthesized by the method not relying on the polymerization of alkylenes are preferred in view of their molecular weight distribution. These may also have a functional group such as a hydroxyl group, a carboxyl group, an amino group, an ester group or an amido group.

The above release agent used in the present invention may also have, in molecular weight distribution measured by GPC, a weight average molecular weight (Mw) of preferably from 500 to 4,000, and more preferably from 800 to 3,600, a number average molecular weight (Mn) of preferably from 300 to 1,300, more preferably from 500 to 1,300, and still more preferably from 600 to 1,000, and Mw/Mn of preferably not more than 3, more preferably not more than 2. The release agent should have a molecular weight distribution in this range. More specifically, if its molecular weight is smaller than the above range, the toner tends to be excessively thermally influenced, resulting in poor blocking resistance and developing performance. If on the other hand its molecular weight is larger than the above range, the external heat can not be effectively utilized making it it difficult to obtain good fixing performance and anti-offset properties. That is, the toner can be endowed with lubricity and any fixed image stain due to offset can be prevented, when the release agent is made to have the molecular weight set within the above range.

In the present invention, the molecular weight distribution of the release agent is measured by gel permeation chromatography (GPC) under the following conditions.

GPC measurement conditions

Apparatus: GPC-150 (Waters Co.)

Columns: GMH-HT 30 cm, two series (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

The molecular weight distribution is measured under conditions described above. Molecular weight of the sample is calculated using a molecular weight calibration curve prepared from a monodisperse polystyrene standard sample. It is calculated by further converting the value in terms of polyethylene according to a conversion formula derived from the Mark-Houwink viscosity formula.

An example thereof is shown in FIG. 1, taking Wax $W_1$ as an example.

With regard to other properties required in the release agent, it may preferably have a softening point of 130° C. or below as measured according to JIS K-2207. If higher than 130° C., the temperature at which the releasability is particularly effective becomes so high that the anti-offset properties may be affected.

The release agent may also have a density of preferably 0.93 g/cm$^3$ or more, and more preferably 0.95 g/cm$^3$ or more, and a penetration of preferably 2.0 ($10^{-1}$ mm) or less, and more preferably 1.5 ($10^{-1}$ mm) or less at 25° C. If they are outside these ranges, the toner tends to undergo changes during low-temperature fixing and also tends to undergo mechanical shear force, tending to result in poor storage stability and developing performance.

The penetration of waxes in the present invention is a value measured according to JIS K-2207. Stated specifically, it is a numerical value corresponding to the depth of penetration measured when a needle having a diameter of about 1 mm and a conical tip with a vertical angle of 9° is penetrated into a sample under a given load, and expressed in units of 0.1 mm. Test conditions in the present invention are as follows: Sample temperature: 25° C.; load: 100 g; and penetration time: 5 seconds.

Such a release agent should preferably be added in an amount of from 0.1 to 15 parts by weight, and more preferably from 0.5 to 10 parts by weight, based on 100 parts by weight of the binder resin. Its addition in an amount less than 0.1 part by weight may make the release of the toner from the fixing roller less effective, tending to cause offset, and also may make the lubricity imparted to the toner insufficient, tending to cause stain of fixed images due to rubbing or feathering. Its addition in an amount more than 15 parts by weight may make the toner weak to heat to bring about a poor blocking resistance.

When the release agent having a high crystallinity and a sharp molecular weight distribution as described above is added in the toner used in the present invention, the toner can enjoy more improved lubricity in the system in which the waste toner is reused, because of the self-lubrication possessed by the release agent, so that the toner may undergo a mechanical impact with difficulty, can have a superior durability and also may cause no decrease in fluidity even in the case of the waste toner to promise a superior performance when transported to the developing step. Hence, a good developing performance can be maintained in an always stable state.

In the toner used in the present invention, the degree of agglomeration that indicates the fluidity of toner after an external additive such as fine silica powder described later has been optionally added to and mixed with toner particles has a difference of preferably 50% or less, and more preferably 40% or less, between the state of a fresh toner having not participated in image formation and the state in which the untransferred toner has been collected by cleaning after running (100,000 sheets) for image formation and is held in a cleaner [degree of agglomeration(%) of collected untransferred toner after running—degree of agglomeration (%) of fresh toner]. This is particularly preferable in the image forming method in which the waste toner is reused.

Such a toner having less difference in the degree of agglomeration before and after running can be achieved by using the release agent having a high crystallinity as described above. This is due to the fact that the external additives such as fine silica powder may be embedded in the surfaces of toner particles with difficulty and therefore the degree of agglomeration of the toner before running can be maintained in the toner after running to achieve less changes in the degree of agglomeration of the toner.

The above fresh toner used in the present invention should preferably have a degree of agglomeration of 20% or less, and more preferably of 15% or less.

Figure 3:
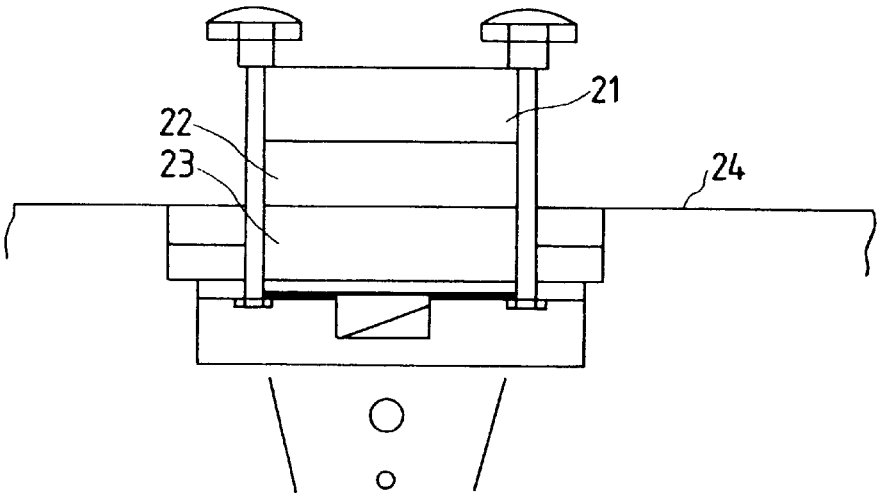
FIG. 3 illustrates an apparatus for measuring the degree of agglomeration of a toner in the present invention.

In the present invention, the degree of agglomeration G of the toner is measured using Powder Tester PT-D type (trade name), manufactured by Hosokawa Micron Corporation. To make the measurement, as shown in FIG. 3, a 60 mesh sieve 21, a 100 mesh sieve 22 and a 200 mesh sieve 23 are set on a vibrating pedestal 24 of Powder Tester. On the 60 mesh 21, 5.0 g of toner is gently placed, and the toner is vibrated for 15 seconds in the state of vibration at a vibrational amplitude of 0.2 mm and a frequency of 50 Hz.

The weight of the toner remaining on each sieve is measured to calculate the degree of agglomeration toner according to the following expression:

$$G_1 = \frac{\text{Toner weight on 60 mesh sieve}}{5.0\ \text{g}} \times 100$$

$$G_2 = \frac{\text{Toner weight on 100 mesh sieve}}{5.0\ \text{g}} \times 100 \times 3/5$$

$$G_3 = \frac{\text{Toner weight on 200 mesh sieve}}{5.0\ \text{g}} \times 100 \times 1/5$$

$$G = G_1 + G_2 + G_3$$

In the toner used in the present invention, a charge control agent may preferably be used by compounding it into toner particles (internal addition) or blending it with toner particles (external addition). The charge control agent enables control of optimum electrostatic charges in conformity with developing systems.

A positive charge control agent may include Nigrosine and products modified with a fatty acid metal salt; quaternary ammonium salts such as tributylbenzylammonium 1-hydroxy-4-naphthosulfonate and tetrabutylammonium teterafluoroborate; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds. Of these, charge control agents such as Nigrosine type charge control agents or quaternary ammonium salt type charge control agents may particularly preferably be used.

Homopolymers of monomers represented by the following Formula:

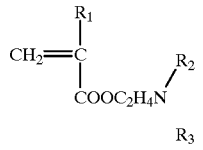

wherein $R_1$ represents H or $CH_3$; and $R_2$ and $R_3$ each represent a substituted or unsubstituted alkyl group, preferably $C_1$ to $C_4$ alkyl group, or copolymers of polymerizable monomers such as styrene, acrylates or methacrylates as described above may also be used as positive charge control agents. In this case, these charge control agents can also act as binder resins (as a whole or in part).

As a negative charge control agent usable in the present invention, for example, organic metal complex salts and chelate compounds are effective, which are exemplified by aluminumacetylacetonato, iron (II) acetylacetonato and chromium 3,5-di-tert-butylsalicylate. In particular, acetylacetone metal complexes, monoazo metal complexes, naphthoic acid or salicylic acid type metal complexes, or salts thereof are preferred, and salicylic acid type metal complexes, monoazo metal complexes and salicylic acid type metal salts are particularly preferred.

The charge control agents described above (those having no action as binder resins) may preferably be used in the form of fine particles. In this case, the charge control agent may preferably have a number average particle diameter of specifically 4 $\mu$m or less, and more preferably 3 $\mu$m or less.

When internally added to the toner, such a charge control agent may preferably be used in an amount of from 0.1 part to 20 parts by weight, and more preferably from 0.2 part to 10 parts by weight, based on 100 parts by weight of the binder resin.

Fine silica powder may preferably be added to the toner of the present invention in order to improve charge stability, developing performance, fluidity and running performance. In particular, fine silica powder may preferably be externally added to the toner particles.

As the fine silica powder used in the present invention, a fine silica powder having a surface specific area, as measured by the BET method using nitrogen absorption, of not less than 30 $m^2/g$, and preferably in the range of from 50 to 400 $m^2/g$, can give good results. The fine silica powder should preferably be used in an amount of from 0.01 part to 8 parts by weight, and more preferably from 0.1 part to 5 parts by weight, based on 100 parts by weight of the toner.

The fine silica powder used in the present invention may preferably be optionally treated, for the purpose of making it hydrophobic or controlling its chargeability, with a treating agent such as silicone varnish, every sort of modified silicone varnish, silicone oil, every sort of modified silicone oil, a silane coupling agent, a silane coupling agent having a functional group, or other organic silicon compound, or with various treating agents used in combination, to give a hydrophobic fine silica powder.

Other additives may include lubricants as exemplified by Teflon, zinc stearate and polyvinylidene fluoride (in particular, polyvinylidene fluoride is preferred); abrasives as exemplified by cerium oxide, silicon carbide and strontium titanate (in particular, strontium titanate is preferred); fluidity-providing agents as exemplified by titanium oxide and aluminum oxide (in particular, hydrophobic one is preferred); anti-caking agents; and conductivity-providing agents as exemplified by carbon black, zinc oxide, antimony oxide and tin oxide. As a developability improver, white fine particles or black fine particles with a reverse polarity may also be used in a small amount.

The colorant usable in the present invention may include any suitable pigments or dyes. The colorant for the toner may include known materials as exemplified by pigments such as carbon black, aniline black, acetylene black, Naphthol Yellow, Hanza Yellow, Rhodamin Lake, Alizarine Lake, red iron oxide, Phthalocyanine Blue and Indanthrene Blue. Any of these may be used in an amount necessary and enough to maintain the optical density of fixed images, and should be added in an amount of from 0.1 to 20 parts by weight, and preferably from 2 to 10 parts by weight, based on 100 parts by weight of the resin. For the same purpose, the colorant may include dyes such as azo dyes, anthraquinone dyes, xanthene dyes and methine dyes. Any of these dyes should be added in an amount of from 0.1 to 20 parts by weight, and preferably from 0.3 to 3 parts by weight, based on 100 parts by weight of the resin.

In the case when the toner of the present invention is a magnetic toner, the toner contains a magnetic material, which may also serve as the colorant. The magnetic material contained in the magnetic toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These ferromagnetic materials should be those having an average particle diameter of from 0.1 to 2 $\mu$m, and preferably from 0.1 to 0.5 $\mu$m, in approximation. Any of these materials should be contained in the toner in an amount of from about 20 to about 200 parts by weight, and particularly preferably from 40 to 150 parts by weight, based on 100 parts by weight of the resin component.

The magnetic material may also preferably those having a coercive force of from 20 to 150 oersted, a saturation magnetizaiton of from 50 to 200 emu/g and a residual magnetization of from 2 to 20 emu/g, as magnetic characteristics under application of 10 K oersted.

In the case when the toner of the present invention is a non-magnetic toner that uses a carrier in combination, the carrier that can be used may include, powders having magnetism as exemplified by iron powder, ferrite powder and nickel powder, glass bead and those obtained by treating particle surfaces of these materials with resin or the like. The carrier should be used in an amount of from 10 to 1,000 parts by weight, and preferably from 30 to 500 parts by weight, based on 10 parts by weight of the toner. The carrier may have a particle diameter of from 4 to 100 $\mu$m, preferably from 10 to 80 $\mu$m, and more preferably from 20 to 60 $\mu$m.

The carrier used in the present invention in order to make the toner used in the present invention participate in development may preferably be coated with a resin and/or a silicone compound. The carrier may preferably be coated also in order to prevent formation of toner spent.

Such coated carrier is advantageous also for durability when used in high-speed machines. The carrier can be coated also for the purpose of charge control of the toner.

As the resin used to form the coating layer of the carrier, it is preferable to use, for example, silicone compounds or fluorine resins.

The fluorine resins used to form the coating layer of the carrier are exemplified by halofluoropolymers such as polyvinyl fluoride, polyvinylidene fluoride, polytrifluoroethylene and polytrifluorochloroethylene; polytetrafluoroethylene, polyperfluoropropylene, a copolymer of vinylidene fluoride with an acrylic monomer, a copolymer of vinylidene fluoride with trifluorochloroethylene, a copolymer of tetrafluoroethylene with hexafluoropropylene, a copolymer of vinyl fluoride with vinylidene fluoride, a copolymer of vinylidene fluoride with tetrafluoroethylene, a copolymer of vinylidene fluoride with hexafluoropropylene, and fluoroterpolymers such as a terpolymer of tetrafluoroethylene with vinylidene fluoride and a non-fluorinated monomer.

The fluorine polymer may preferably have a weight average molecular weight of from 50,000 to 400,000, and preferably from 100,000 to 250,000.

To form the coating layer of the carrier, the fluorine resins as described above may each be used alone or may be used in the form of a blend of any of these. Blends to which other polymers have been further blended may also be used.

As other polymers, homopolymers or copolymers of monomers as shown below are used.

They include vinyl monomers having a vinyl group in the molecule, as exemplified by styrene, styrene derivatives such as a-methylstyrene, p-methylstyrene, p-t-butyl-styrene and p-chlorostyrene, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxyethyl methacrylate, propoxyethyl methacrylate, butoxyethyl methacrylate, methoxydiethylene glycol methacrylate, ethoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyethyl methacrylate, N-vinyl-2-pyrrolidone methacrylate, methacrylonitrile, methacrylamide, N-methylolmethacrylamide, ethylmorpholine methacrylate, diacetoneacrylamide, methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, methoxyethyl acrylate, propoxyethyl acrylate, butoxyethyl acrylate, methoxydiethylene glycol acrylate, ethoxydiethylene glycol acrylate, methoxyethylene glycol acrylate, butoxytriethylene glycol acrylate, methoxydipropylene glycol acrylate, phenoxyethyl acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, glycidyl acrylate, acrylonitrile, acrylamide, N-methylolacrylamide, deacetoneacrylamide, ethylmorpholine acrylate and vinylpyridine; acrylic monomers having two or more vinyl groups in the molecule as exemplified by divinylbenzene, reaction products of glycol with methacrylic acid or acrylic acid, as exemplified by ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, polyethylene glycol dimethacrylate, tripropylene glycol dimethacrylate, hydroxypivalic acid neopentyl glycol ester dimethacrylate, trimethylolethane trimethacrylate, trimethylolpropane trimethacrylate, pentaerythritol tetramethacrylate, trismethacryloxyethyl phosphate, tris (methacryloyloxyethyl) isocyanurate, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, polyethylene glycol diacrylate, tripropylene glycol diacrylate, hydroxypivalic acid neopentyl glycol diacrylate, trimethylolethane triacrylate, trimethylolpropane triacrylate, pentaerythritol tetraacrylate, trisacryloxyethyl phosphate and tris (methacryloyloxyethyl) isocyanurate, half-esterification products of glycidyl methacrylate with methacrylic acid or acrylic acid, half-esterification products of bisphenol type epoxy resin with methacrylic acid or acrylic acid, and half-esterification products of glycidyl acrylate with methacrylic acid or acrylic acid; and acrylic monomers having a hydroxyl group as exemplified by 2-hydroxyethyl acrylate, 2-hydroxypropyl acrylate, hydroxybutyl acrylate, 2-hydroxy-3-phenyloxypropyl acrylate, 2-hydroxyethyl methacrylate, 2-hydroxypropyl methacrylate, hydroxybutyl methacrylate, 2-hydroxy-3-phenyloxypropyl methacrylate.

These vinyl monomers are copolymerized by known processes such as suspension polymerization, emulsion polymerization and solution polymerization. The resulting copolymers may preferably have a weight average molecular weight of from 10,000 to 70,000. The copolymers may be also subjected to melamine aldehyde cross-linking or isocyanate cross-linking.

The fluorine resin and other polymer may preferably be blended in a ratio of 20 to 80:80 to 20% by weight, and particularly 40 to 60:60 to 40% by weight.

As the silicone compound used to form the coating layer of the carrier, polysiloxanes as exemplified by dimethyl polysiloxane and phenylmethyl polysiloxane are used. It is also possible to use modified resins such as alkyd-modified silicone, epoxy-modified silicone, polyester-modified silicone, urethane-modified silicone and acryl-modified silicone.

As the form of modification, any of block copolymers, graft copolymers and comb-type graft polysiloxanes can be used.

When they are actually applied to the surfaces of magnetic particles, a method is employed in which a silicone resin is previously converted into varnish as exemplified by solid methyl silicone varnish, solid phenyl silicone varnish, solid methyl phenyl silicone varnish, solid ethyl silicone varnish and various types of modified silicone varnishes and the magnetic particles are dispersed therein, or a method in which the varnish is sprayed on the magnetic particles.

As a core material of the carrier used in the present invention, for example, surface-oxidized or -unoxidized metals such as iron, nickel, cobalt, manganese, chromium or rare earth elements and also alloys or oxides thereof can be used. Metal oxide particles can be preferably used, and magnetic ferrite particles can be more preferably used.

There are no particular limitations on the method for producing it.

The carrier should be those having an average particle diameter of from 4 to 100 $\mu$m.

If the carrier has an average particle diameter smaller than 4 $\mu$m, the carrier tends to be developed on (i.e., transferred together with toner to) the latent image bearing member, tending to scratch the latent image bearing member or the cleaning blade. If on the other hand the carrier has an average particle diameter larger than 100 $\mu$m, the toner-holding ability of the carrier may be lowered, tending to cause uneven solid images, toner scatter and fog. Such a carrier core material may be comprised of only a magnetic material or may be comprised of a combination of a magnetic material and a non-magnetic material. It may also be a mixture of two or more kinds of magnetic particles.

The surface of the above carrier core material may be coated with the above coating resin preferably by a method in which the resin is dissolved or suspended in a solvent and the solution or suspension is coated on core surfaces so as for the resin to adhere to the core comprised of magnetic particles.

The treatment with the coating resin should preferably be in an amount usually of from 0.1 to 30% by weight, and preferably from 0.5 to 20% by weight, based on the weight of the carrier core material in total weight, in view of film forming properties or durability of the coating material.

The toner according to the present invention can be produced in the following way: A vinyl type or non-vinyl type thermoplastic resin, a release agent, a magnetic powder or a pigment or dye as a colorant, (a magnetic material when a magnetic toner is formed), a charge control agent and other additives are thoroughly mixed using a mixing machine such as a ball mill, and then the mixture is melt-kneaded using a kneading machine such as a heating roll, a kneader or an extruder to make the resin and so on melt one another, in which a pigment or dye is then dispersed or dissolved, followed by cooling for solidification and thereafter pulverization and classification. Thus the toner used in the present invention can be obtained.

The image forming method of the present invention will be described in detail with reference to an image forming apparatus shown in FIG. 2.

Reference numeral 1 denotes a developer assembly, which holds the toner. A charge is imparted to the toner by its contact with the surface of a toner carrying member 10 or a blade 12 thereof, and the toner is applied to the surface of the toner carrying member 10 in the form of a thin layer. A photosensitive drum as an electrostatic latent image bearing member 11 is primarily charged by means of a primary corona assembly 5, and an electrostatic latent image is formed by a latent image forming means (not shown). This electrostatic latent image is developed by the toner applied to the surface of the toner carrying member 10, to form a toner image. This toner image is transferred to a recording medium by means of a transfer corona assembly 7 such as a corona charger, and the toner image is fixed to the recording medium by a fixing means such as heat-roller fixing assembly (not shown). After the transfer, the electrostatic latent image bearing member is subjected to charge elimination by means of a charge eliminating needle 8 capable of effecting erase exposure. Then the untransferred toner adhering to the surface of the electrostatic latent image bearing member 11 is scraped off by a cleaning means such as a cleaning blade, and collected. The toner thus collected is sent to the inside of a cleaner 2, and fed to the developer assembly 1 through a screw 4, by means of a waste toner transporting pipe 6 provided with a transport screw and via a hopper 9. Thus, the waste toner is again used in image formation.

The toner collected may be directly fed to the developer assembly 1, the developing means, not via the hopper 9.

The layer of the toner applied to the surface of the toner carrying member 10 may be so made as to have a layer thickness smaller than the gap between the surface of the toner carrying member 10 and the surface of the electrostatic latent image bearing member 11 in the developing zone so that the developing can be carried out while the toner is caused to fly from the surface of the toner carrying member 10 to the electrostatic latent image formed on the electrostatic latent image bearing member 11. Such a method is preferred.

In this developing, developing may also preferably be carried out using a toner with triboelectricity while an alternating electric field is applied across the surface of the toner carrying member 10 and the surface of the electrostatic latent image bearing member.

The alternating electric field is exemplified by a pulse electric field, an alternating current bias or an alternating current-direct current bias superimposed electric field.

In the present invention, the image forming method comprises;

forming a toner image by developing through a developing means an electrostatic latent image formed on an electrostatic latent image bearing member;

transferring the toner image formed on the electrostatic latent image bearing member, to a recording medium;

cleaning the electrostatic latent image bearing member from which the toner image has been transferred to the transfer medium, to collect untransferred toner remaining on the electrostatic latent image bearing member;

feeding the toner collected, to said developing means so as to be again held in the developing means and used to form a toner image on the electrostatic latent image bearing member; and fixing the toner image transferred to the recording medium, to the recording medium through a fixing means;

the toner comprising a binder resin, a colorant and a release agent, in which the binder resin has at least one peak in the region of a molecular weight of from 2,000 to 50,000 and at least a peak or a shoulder in the region of a molecular weight of not less than 100,000, in molecular weight distribution as measured by gel permeation chromatography (GPC), and the release agent has a methylene chain, is used as the toner held in the developing means. Hence, also in the image forming method in which the specific toner described above is reused, the toner can have superior fixing performance, anti-offset properties, blocking resistance and developing performance and can form good images. In addition, since the toner is tough to mechanical impact and also may suffer no mechanical impact because of its good lubricity, a high image density like that at the initial stage can be achieved also after running over a long period of time and on a large number of copy sheets. Moreover, since the reuse of the toner contributes to effective utilization of the toner, copied images with a high image density and a high image quality can be obtained at a smaller toner consumption.

EXAMPLES

The present invention will be described below in greater detail by giving Examples. The present invention is by no means limited to these. In the following, "part(s)" refers to "part(s) by weight" in all occurrences.

| Resin Synthesis Example 1 | |
|---|---|
| Styrene | 78 parts |
| n-Butyl acrylate | 22 parts |
| Di-tert-butyl peroxide | 1 part |

The above components were dropwise added to 200 parts of cumene over a period of 4 hours. Then the polymerization was completed under reflux of cumene, and the cumene was removed while the temperature was raised (120° C.) under reduced pressure to give low-molecular weight polymer B1'.

Next, 30 parts of the low-molecular weight polymer B1' was dissolved in the following monomer mixture to form a mixture solution.

| | |
|---|---|
| Styrene | 50 parts |
| n-Butyl acrylate | 17 parts |
| Monobutyl maleate | 3 parts |
| Divinyl benzene | 0.1 part |
| Azobisisobutyronitrile | 0.7 part |

To the above mixture solution, 170 parts of water in which 0.1 part of a polyvinyl alcohol partially saponified product had been dissolved was added to form a suspension dispersion. In a reactor containing 15 parts of water and substituted with nitrogen, the suspension dispersion was added to carry out suspension polymerization at a reaction temperature of 80° C. for 7 hours. After the reaction was completed, filtration, dewatering and drying were carried out to obtain resin composition B1. The resulting resin composition B1 had a peak at a molecular weight of 13,000 and a shoulder at a molecular weight of 598,000 in its GPC chart.

| Resin Synthesis Example 2 | |
|---|---|
| Styrene | 71.5 parts |
| n-Butyl acrylate | 25 parts |
| Monobutyl maleate | 3 parts |
| Divinylbenzene | 0.5 part |
| Benzoyl peroxide | 1 part |
| Di-tert-butyl peroxy-2-ethylhexanoate | 0.9 part |

To a mixture solution of the above materials, 170 parts of water in which 0.1 part of a polyvinyl alcohol partially saponified product had been dissolved was added, followed by vigorous stirring to form a suspension dispersion. In a reactor containing 50 parts of water and substituted with nitrogen, the suspension dispersion was added to carry out suspension polymerization at a reaction temperature of 80° C. for 8 hours. After the reaction was completed, the reaction mixture was washed with water, followed by dewatering and drying to obtain high-molecular weight polymer B2'.

| | |
|---|---|
| Styrene | 78 parts |
| n-Butyl acrylate | 22 parts |
| Di-tert-butyl peroxide | 1.5 parts |

The above materials were dropwise added to 200 parts of heated toluene over a period of 4 hours. Then the polymerization was completed under reflux of toluene. To the reaction mixture, the above high-molecular weight polymer resin B2' was added so as to be in a proportion of B2': this polymer=25:75, followed by thorough stirring, and thereafter the toluene was removed while the temperature was raised (120° C.) under reduced pressure to give resin composition B2. The resulting resin composition B2 had a peak at a molecular weight of 23,000 and a sub-peak at a molecular weight of 720,000 in its GPC chart.

| Resin Synthesis Example 3 | |
|---|---|
| Styrene | 77 parts |
| n-Butyl acrylate | 21 parts |
| Monobutyl maleate | 2 parts |
| Divinyl benzene | 0.3 part |
| Di-tert-butyl peroxy-2-ethylhexanoate | 0.6 part |

The above materials were dropwise added to 200 parts of heated xylene over a period of 4 hours. Then the polymerization was completed under reflux of xylene, and the xylene was removed while the temperature was raised (120° C.) under reduced pressure to give high-molecular weight resin B3'.

| | |
|---|---|
| Styrene | 78 parts |
| n-Butyl acrylate | 22 parts |
| Di-tert-butyl peroxide | 0.9 part |

The above materials were dropwise added to 200 parts of heated toluene over a period of 4 hours. Then the polymerization was completed under reflux of toluene. To the reaction mixture, the above high-molecular weight resin R3' was added so as to be in a proportion of R3': this polymer=4:6, followed by thorough stirring, and thereafter the toluene was removed while the temperature was raised under reduced pressure to give resin composition B3. The resulting resin composition B3 had peaks at molecular weights of 17,000 and 180,000 in its GPC chart.

Resin Synthesis Comparative Example 1

The low-molecular weight polymer B1' in Resin Synthesis Example 1 was used. This resin had a peak only at a molecular weight of 15,000.

Resin Synthesis Comparative Example 2

The high-molecular weight polymer B2' in Resin Synthesis Example 2 was used. This resin had a peak only at a molecular weight of 750,000.

| Resin Synthesis Example 4 | |
|---|---|
| Bisphenol-A | 20 mol % |
| Terephthalic acid | 40 mol % |
| n-Dodecenylsuccinic acid | 10 mol % |
| Trimellitic acid | 5 mol % |
| Triethylene glycol | 25 mol % |

The above materials were subjected to condensation polymerization to obtain resin composition B4. The resin composition B4 had a peak at a molecular weight of 8,000 in its GPC chart.

| Resin Synthesis Example 5 | |
|---|---|
| Bisphenol-A | 50 mol % |
| Fumaric acid | 15 mol % |
| Adipic acid | 10 mol % |
| Terephthalic acid | 10 mol % |
| Trimellitic acid | 15 mol % |

The above materials were subjected to condensation polymerization to obtain resin composition B5. The resin composition B5 had a peak at a molecular weight of 174,000 in its GPC chart.

The molecular weight distribution of the above resin components was measured using GPC (a high-speed liquid chromatograph 150C, available from Waters Co.) and columns comprising a combination of Shodex GPC KF-801, 802, 803, 804, 805, 806, 807 and 800P, available from Showa Denko KK. Sample concentration was so adjusted as to be 5 mg/ml of the resin component.

Syntheses of Release Agents 1 to 4

Ethylene was subjected to low-pressure polymerization in the presence of a Ziegler catalyst to obtain wax W1 (release agent 1). Hydrocarbon wax W3 (comparative release agent 3) synthesized by the Arge process from a synthesis gas of carbon monoxide and hydrogen was subjected to fractionation crystallization to obtain wax W2 (release agent 2) and wax W4 (comparative release agent 4).

Synthesis of Release Agent 5

Ethylene was polymerized in the presence of a Ziegler catalyst. After the polymerization was completed, the polymer was oxidized to form an alkoxide of the metal catalyst with polyethylene, further followed by hydrolysis to obtain wax W5 (a long-chain alkyl alcohol).

Synthesis of Comparative Release Agent 1

An alkylenebis(fatty acid)amide (designated as W6) of the following formula.

$$CH_3CO—NH—CH_2—NH—OCCH_3$$

Physical properties and DSC measurements of the above release agents 1 to 6 and comparative release agent 1 are shown in Table 1.

TABLE 1

| Release agent No. | Number average molecular weight (Mn) | Weight average molecular weight (Mw) | Mw/Mn | DSC curve temp. rise onset temp. (° C.) | DSC Curve temp. rise endothermic peak temp. (° C.) | *1 Onset temp. difference (° C.) | Penetration ($10^{-1}$mm) | Density ($g \cdot cm^{-3}$) | Softening point (° C.) |
|---|---|---|---|---|---|---|---|---|---|
| 1 (Wax W1) | 770 | 1,270 | 1.65 | 67 | 106*; 112 | 58 | 0.8 | 0.96 | 116 |
| 2 (Wax W2) | 920 | 1,450 | 1.58 | 69 | 110*; 117 | 50 | 0.7 | 0.97 | 118 |
| Comp. 3 (Wax W3) | 700 | 3,300 | 4.71 | 93 | 135* | 75 | 1.0 | 0.97 | 131 |
| Comp. 4 (Wax W4) | 450 | 850 | 1.89 | 64 | 80; 101* | 40 | 2.0 | 0.96 | 102 |
| 5 (Wax W5) | 720 | 1,300 | 1.81 | 72 | 105*; 117 | 50 | 0.9 | 0.97 | 120 |
| Comparative release agent 1 (Wax W6) | 200 | 500 | 2.5 | 40 | 60*; 80 | 20 | 0.6 | 0.75 | 87 |

*1: Difference between end point onset temperature of endothermic peak at temperature rise in DSC curve and onset temperature of the endothermic peak

Example 1

| | |
|---|---|
| Resin composition B1 | 100 parts |
| Magnetite | 85 parts |
| Nigrosine | 2 parts |
| Release agent 1 | 4 parts |

The above materials were premixed using a Henschel mixer, and then melt-kneaded at 120° C. using a twin-screw kneading extruder. The resulting kneaded product was cooled, and then crushed using a cutter mill. Thereafter, the crushed product was finely pulverized using a fine grinding mill utilizing a jet stream. The resulting finely pulverized product was classified using an air classifier to obtain toner particles (a toner) with a weight average particle diameter ($D_4$) of 8.5 $\mu$m.

To 100 parts of the toner thus obtained, 0.6 part of positively chargeable fine silica powder (BET specific surface area: 130 $m^2/g$) treated with 20 parts of an amino-modified silicone oil with an amine value of 700 was added, followed by dry blending to give a one-component developer (a toner).

Figure 2:
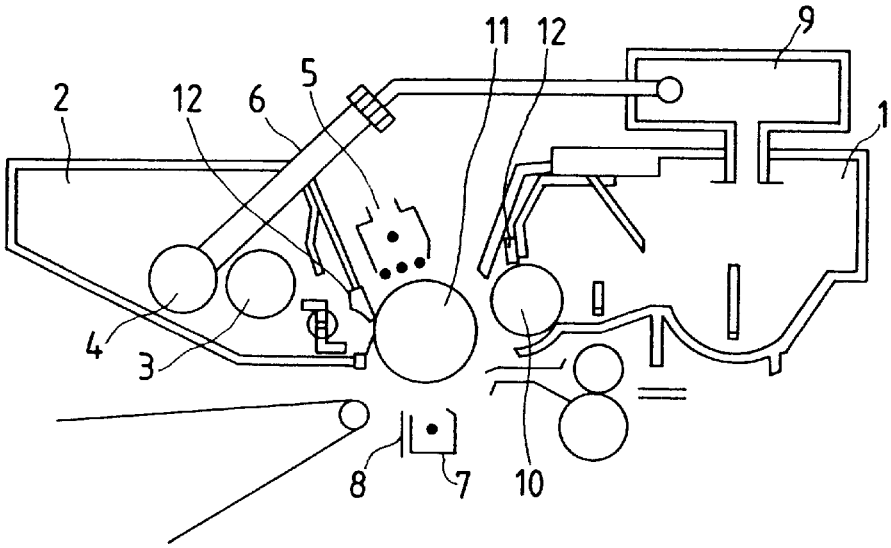
FIG. 2 illustrates an image forming apparatus employing the image forming method of the present invention in which the untransferred toner is reused.

The developer thus obtained was used in a copying machine NP-1215 (a curvature separated type employing an OPC multilayered type negatively chargeable photosensitive member with a drum diameter of 30 mm), manufactured by Canon Inc., which was modified as shown in FIG. 2.

Primary charging was applied at −700V, the gap between the surface of the photosensitive drum and the developer layer on a developing sleeve (provided with magnets in its inside) was set in non-contact, and images were reproduced by normal development while an alternating current bias (f: 1,800 Hz; $V_{pp}$: 160 V) and a direct current bias ($V_{DC}$: −300 V) were applied across the developing sleeve and the photosensitive drum. After developing, toner images were transferred to plain paper by means of a corona charger, and the untransferred toner remaining on the photosensitive drum was scraped off by means of an elastic blade 12 belonging to the cleaner 2 and coming into contact with the photosensitive drum, thereafter sent to the inside of the cleaner by means of a cleaner roller 3, and fed back to the developer assembly 1 through a cleaner screw 4, by means of a feeding pipe 6 provided with a transport screw and via a hopper 9.

Continuous 200,000 sheet image reproduction was carried out to make evaluation. As a result, an always high reflection image density was maintained, and always good images were obtained without causing both fogging and toner scatter. After the 200,000 sheet image reproduction, toner consumption was examined using an A4-size original so prepared as to have an image area percentage of 6%. As a result, it was found to be 0.050 g/sheet.

The degree of agglomeration of unused fresh toner (the one-component developer) and the degree of agglomeration of the toner held in the cleaner 2 after running were each measured to find a difference in degree of agglomeration of the both.

Results of evaluation are shown in Table 3.

Fixing performance was tested in the following way: The machine for evaluation was left to stand overnight in an environment of low temperature and low humidity (15° C., 10%RH) until the machine and its inside fixing assembly completely adapted themselves to the environment of low temperature and low humidity. Under this condition, image reproduction was started to continuously take copies on 200 sheets, and a copied image on the 200th sheet was used as a standard for the evaluation of fixing performance. To evaluate the fixing performance, images were rubbed 10 times using Silbon paper under a load of about 100 g to examine any separation of the images, which was evaluated as the rate (%) of decrease in reflection density according to the following evaluation criteria.

Evaluation criteria:

A: 10% or less.

AB: More than 10% to 18% or less.

B: More than 18% to 25% or less.

C: More than 25%.

Anti-offset properties were evaluated on the basis of the number of copies taken until images were stained or rollers were contaminated, in the state the cleaning mechanism of fixing rollers was detached, and were evaluated as the number of offset-free copies according to the following evaluation criteria.

Evaluation criteria:

A: 1,500 sheets or more.

AB: 1,000 to less than 1,500 sheets.

B: 200 to less than 1,000 sheets.

C: Less than 200 sheets.

Blocking resistance was evaluated by examining the change of the degree of agglomeration when about 10 g of toner was put in a 100 cc polyethylene cup and left to stand a day at 50° C. The degree of agglomeration was measured using Powder Tester, manufactured by Hosokawa Micron Corporation. The blocking resistance was evaluated as a difference in the degree of agglomeration between a product left at room temperature and a product left at 50° C./a day, and according to the following criteria.

Evaluation criteria:

A: 10% or less.

AB: More than 10% to 20% or less.

B: More than 20% to 30% or less.

C: More than 30%.

Image quality was evaluated on the basis of the standard sample of images and according to the following criteria.

Evaluation criteria:

A: Very good.

AB: Good.

B: Lowered, but at a level not problematic in practical use.

C: Untolerable in practical use.

Fog was evaluated in the following way: An average value (10-point average) of white-ground reflectance (or whiteness) after fixing was represented by Ds and an average value (10-point average) of white-ground reflectance (or whiteness) of an original sheet was represented by Dr, where a value of Ds−Dr was regarded as the fog. The values of reflectance were measured using a reflection densitometer (REFLECTOMETER MODEL TC-6DC, manufactured by Tokyo Denshoku Co., Ltd.), assuming the reflectance of a black standard plate as 0% and the reflectance of a white standard plate as 89%. The fog was evaluated according to the following criteria.

Evaluation criteria:

A: 2% or less.

AB: More than 2% to 4% or less.

B: More than 4% to 6% or less.

C: More than 6%.

Black spots around images were evaluated by visual observation of image quality on the basis of the standard sample of images and according to the following criteria.

Evaluation criteria:

A: Very good.

AB: Good.

B: Occurred, but at a level not problematic in practical use.

C: Untolerable in practical use.

Example 2

A toner was prepared in the same manner as in Example 1 except that the resin composition B1 used therein was replaced with 100 parts of the resin composition B2, Nigrosine was replaced with 2 parts of tetrabutylammonium tetrafluoroborate, the release agent 1 was replaced with 3 parts of the release agent 2 and the amount of magnetite used was changed to 80 parts, that is, the formulation changed as shown in Table 2. Image evaluation was also made similarly. Results of the evaluation are shown in Tables 3(A) to 3(E).

Example 3

A toner was prepared in the same manner as in Example 1 except that the resin composition B1 used therein was replaced with 100 parts of the resin composition B3, the amount of Nigrosine used was changed to 3 parts and the amount of magnetite used was changed to 90 parts, that is, the formulation changed as shown in Table 2. Image evaluation was also made similarly. Results of the evaluation are shown in Tables 3(A) to 3(E).

Example 4

A toner was prepared in the same manner as in Example 1 except that the resin composition B1 used therein was replaced with 50 parts of the resin composition B4 and 50 parts of the resin composition B5, that is, the formulation changed as shown in Table 2. Image evaluation was also made similarly. Results of the evaluation are shown in Tables 3(A) to 3(E). Here, the GPC measurement made on the resin component of the toner revealed that the resin had peaks at molecular weights of 8,000 and 172,000.

Comparative Example 6

A toner was prepared in the same manner as in Example 1 except that the release agent 1 used therein was replaced with 4 parts of the comparative release agent 3, that is, the formulation changed as shown in Table 2. Image evaluation was also made similarly. Results of the evaluation are shown in Tables 3(A) to 3(E).

Comparative Example 7

A toner was prepared in the same manner as in Example 1 except that the release agent 1 used therein was replaced with 4 parts of the comparative release agent 4, that is, the formulation changed as shown in Table 2. Image evaluation was also made similarly. Results of the evaluation are shown in Tables 3(A) to 3(E).

Example 7

A toner was prepared in the same manner as in Example 1 except that the release agent 1 used therein was replaced with 4 parts of the release agent 5, that is, the formulation changed as shown in Table 2. Image evaluation was also made similarly. Results of the evaluation are shown in Tables 3(A) to 3(E).

Example 8

A toner was prepared in the same manner as in Example 1 except that Nigrosine used therein was replaced with 2 parts of an acetylsalicylic acid chromium complex, a negatively chargeable fine silica powder (BET specific surface area: 200 $m^2/g$) treated with 20% by weight of hexamethyldisialzane, that is, the formulation changed as shown in Table 2. Image evaluation was also made similarly provided that the development was carried out by reversal processing. Results of the evaluation are shown in Tables 3(A) to 3(E).

Example 9

A toner was prepared in the same manner as in Example 1 except that the magnetite used therein was replaced with 4 parts of carbon black, that is, the formulation changed as shown in Table 2. Image evaluation was also made similarly. Results of the evaluation are shown in Tables 3(A) to 3(E).

The image evaluation was made using the same copying machine as used in Example 1, except that its developer assembly was replaced with a developer assembly used for non-magnetic toners. As a carrier, a ferrite carrier (volume average particle diameter: 50 $\mu$m) coated with 1.2% by weight of a 1:1 mixed resin of a vinylidene fluoride/tetrafluoroethylene copolymer (polymerization weight ratio of monomers: 75/25) and a styrene/methacrylate copolymer (polymerization weight ratio of monomers: 70/30) was used, where the blending ratio of the toner to the carrier was 10% by weight.

Example 10

Using the toner used in Example 1 and using the copying machine (NP-1215, manufactured by Canon Inc.) also used in Example 1, image evaluation was made in the same manner as in Example 1 except that a system in which the waste toner (the untransferred toner) was directly fed back to the developer assembly, not via the hopper 9. Results obtained are shown in Tables 3(A) to 3(E).

Comparative Example 1

A toner was prepared in the same manner as in Example 1 except that the resin composition B1 used therein was replaced with 100 parts of the resin composition B1', that is, the formulation changed as shown in Table 2. Image evaluation was also made similarly. Results of the evaluation are shown in Tables 3(A) to 3(E).

Comparative Example 2

A toner was prepared in the same manner as in Example 1 except that the resin composition B1 used therein was replaced with 100 parts of the resin composition B2', Nigrosine was replaced with 2 parts of tetrabutylammonium tetrafluoroborate, the release agent 1 was replaced with 3 parts of the release agent 2 and the amount of magnetite used was changed to 80 parts, that is, the formulation changed as shown in Table 2. Image evaluation was also made similarly. Results of the evaluation are shown in Tables 3(A) to 3(E).

Comparative Example 3

A toner was prepared in the same manner as in Example 1 except that the resin composition B1 used therein was replaced with 100 parts of the resin composition B4, that is, the formulation changed as shown in Table 2. Image evaluation was also made similarly. Results of the evaluation are shown in Tables 3(A) to 3(E).

Comparative Example 4

A toner was prepared in the same manner as in Example 1 except that the release agent 1 used therein was replaced with 4 parts of the comparative release agent 1, that is, the formulation changed as shown in Table 2. Image evaluation was also made similarly. Results of the evaluation are shown in Tables 3(A) to 3(E).

Comparative Example 5

Image evaluation was made in the same manner as in Example 1 except that the toner used in Example 1 was used in a copying machine (NP-1215, manufactured by Canon Inc.; a usual apparatus in which the untransferred toner is not fed back to the developing means). As a result, there was no problem in image characteristics and so forth from beginning to end, but the toner consumption was 0.059 g/sheet, which increased by 18% compared with the case of Example 1.

TABLE 2

| | Binder resin (parts) | Charge control agent (parts) | Release agent No. (parts) | Magnetic material (parts) | Coloring agent (parts) | Toner $D_4$ ($\mu$m | Low-molecular weight side, peak molecular weight | High-molecular weight side, peak or shoulder molecular weight |
|---|---|---|---|---|---|---|---|---|
| Example: | | | | | | | | |
| 1 | B1 (100) | Nigrosine (2) | No. 1 (4) | Magnetite (85) | None | 8.5 | 13,000 | 550,000 |
| 2 | B2 (100) | TBAmTFB (2) | No. 2 (3) | Magnetite (80) | None | 8.6 | 24,000 | 690,000 |
| 3 | B3 (100) | Nigrosine (3) | No. 1 (4) | Magnetite (90) | None | 8.7 | 17,000 | 180,000 |
| 4 | B4 (50) B5 (50) | Nigrosine (2) | Comparative Release Agent No. 1 | Magnetite (85) | None | 8.5 | 8,000 | 172,000 |
| Comp. Ex. 6 | B1 (100) | Nigrosine(2) | No. 3 (4) | Magnetite (85) | None | 8.6 | 13,000 | 549,000 |
| Comp. Ex. 7 | B1 (100) | Nigrosine(2) | Comp. No. 4 (4) | Magnetite (85) | None | 8.5 | 13,000 | 552,000 |
| 7 | B1 (100) | Nigrosine(2) | No. 5 (4) | Magnetite (85) | None | 8.5 | 13,000 | 560,000 |
| 8 | B1 (100) | AcS-Cr(2) | No. 1 (3) | Magnetite (85) | None | 8.6 | 15,000 | 720,000 |
| 9 | B1 (100) | Nigrosine(2) | No. 1 (4) | None | Carbon black (4) | 8.5 | 13,000 | 550,000 |
| Comparative Example: | | | | | | | | |
| 1 | B1' (100) | Nigrosine (2) | No. 1 (4) | Magnetite (85) | None | 8.4 | 13,000 | — |
| 2 | B2' (100) | TBAmTFB (2) | No. 2 (3) | Magnetite (80) | None | 8.9 | | 560,000 |
| 3 | B4 (100) | Nigrosine (2) | No. 1 (4) | Magnetite (85) | None | 8.5 | 8,000 | — |
| 4 | B1 (100) | Nigrosine (2) | No. 1 (4) | Magnetite (85) | None | 8.5 | 13,000 | 550,000 |

TBAmTFB: Tetrabutylammonium tetrafluoroborate
AcS-Cr: Acetylsalicylic acid chromium complex

TABLE 3(A)

| | Grind-ability | Fixing performance (*1) | Anti-offset properties (*2) | Blocking resistance (*3) |
|---|---|---|---|---|
| Example: | | | | |
| 1 | A | A (7%) | A | A (7%) |
| 2 | A | A (10%) | A | A (3%) |
| 3 | A | A (6%) | A | A (9%) |
| 4 | A | A (10%) | A | A (4%) |
| Comp. Ex. 6 | A | AB (15%) | B (400th) | AB (15%) |

TABLE 3(A)-continued

| | Grind-ability | Fixing performance (*1) | Anti-offset properties (*2) | Blocking resistance (*3) |
|---|---|---|---|---|
| Comp. Ex. 7 | A | A (6%) | B (500th) | AB (20%) |
| 7 | A | A (3%) | A | A (5%) |
| 8 | A | A (8%) | A | A (7%) |
| 9 | A | A (8%) | A | A (6%) |
| 10 | A | A (7%) | A | A (7%) |
| Comparative Example: | | | | |
| 1 | A | A (5%) | C (120th) | C (38%) |
| 2 | C | C (30%) | B (280th) | A (4%) |
| 3 | A | A (3%) | C (100th) | C (40%) |
| 4 | A | C (27%) | C (10th) | C (70%) |

(*1) Rate of density decrease;
(*2) Number of the sheet on which stain on back on paper occurred;
(*3) Rate of change in degree of agglomeration

TABLE 3(B)

| | Results of evaluation at the start | | | | |
|---|---|---|---|---|---|
| | Dmax | Image quality | Fog | Black spots around images | Degree of agglomeration |
| Example: | | | | | |
| 1 | 1.32 | A | A | A | 3 |
| 2 | 1.34 | A | A | A | 5 |
| 3 | 1.31 | A | A | A | 5 |
| 4 | 1.35 | A | A | A | 10 |
| Comp. Ex. 6 | 1.32 | A | A | A | 15 |
| Comp. Ex. 7 | 1.31 | A | A | A | 17 |
| 7 | 1.40 | A | A | A | 6 |
| 8 | 1.35 | A | A | A | 10 |
| 9 | 1.30 | A | A | A | 9 |
| 10 | 1.32 | A | A | A | 3 |
| Comparative Example: | | | | | |
| 1 | 1.27 | A | A | A | 20 |
| 2 | 1.20 | B | A | A | 7 |
| 3 | 1.21 | B | A | A | 25 |
| 4 | 1.00 | C | B | B | 30 |

TABLE 3(C)

| | Results of evaluation at 100,000 sheets | | | | |
|---|---|---|---|---|---|
| | Dmax | Image quality | Fog | Black spots around images | Degree of agglomeration |
| Example: | | | | | |
| 1 | 1.35 | A | A | A | 25 |
| 2 | 1.37 | A | A | A | 30 |
| 3 | 1.32 | A | A | A | 29 |
| 4 | 1.37 | A | A | A | 35 |
| Comp. Ex. 6 | 1.30 | A | A | A | 37 |
| Comp. Ex. 7 | 1.30 | A | AB | AB | 38 |
| 7 | 1.40 | A | A | A | 27 |
| 8 | 1.37 | A | A | A | 29 |
| 9 | 1.35 | A | A | A | 31 |
| 10 | 1.35 | A | A | A | 25 |

TABLE 3(C)-continued

| | Results of evaluation at 100,000 sheets | | | | |
|---|---|---|---|---|---|
| | Dmax | Image quality | Fog | Black spots around images | Degree of agglomeration |
| Comparative Example: | | | | | |
| 1 | 0.95 | C | C | C | 75 |
| 2 | 1.00 | C | C | C | 55 |
| 3 | 0.90 | C | C | C | 70 |
| 4 | 0.50 | C | C | C | 80 |

TABLE 3(D)

| | Results of evaluation at 150,000 sheets | | | | |
|---|---|---|---|---|---|
| | Dmax | Image quality | Fog | Black spots around images | Degree of agglomeration |
| Example: | | | | | |
| 1 | 1.35 | A | A | A | 26 |
| 2 | 1.36 | A | A | A | 31 |
| 3 | 1.34 | A | A | A | 29 |
| 4 | 1.40 | A | A | A | 35 |
| Comp. Ex. 6 | 1.30 | AB | AB | AB | 37 |
| Comp. Ex. 7 | 1.28 | AB | AB | AB | 38 |
| 7 | 1.40 | A | A | A | 27 |
| 8 | 1.40 | A | A | A | 30 |
| 9 | 1.40 | A | A | A | 30 |
| 10 | 1.35 | A | A | A | 26 |
| Comparative Example: | | | | | |
| 1 | — | — | — | — | — |
| 2 | — | — | — | — | — |
| 3 | — | — | — | — | — |
| 4 | — | — | — | — | — |

TABLE 3(E)

| | Results of evaluation at 200,000 sheets | | | | |
|---|---|---|---|---|---|
| | Dmax | Image quality | Fog | Black spots around images | Degree of agglomeration |
| Example: | | | | | |
| 1 | 1.35 | A | A | A | 27 |
| 2 | 1.36 | A | A | A | 32 |
| 3 | 1.35 | A | A | A | 30 |
| 4 | 1.38 | A | A | A | 36 |
| Comp. Ex. 6 | — | — | — | — | — |
| Comp. Ex. 7 | — | — | — | — | — |
| 7 | 1.40 | A | A | A | 28 |
| 8 | 1.37 | A | A | A | 34 |
| 9 | 1.33 | A | A | A | 32 |
| 10 | 1.36 | A | A | A | 27 |
| Comparative Example: | | | | | |
| 1 | — | — | — | — | — |
| 2 | — | — | — | — | — |
| 3 | — | — | — | — | — |
| 4 | — | — | — | — | — |

What is claimed is:

1. An image forming method comprising:

(a) forming an electrostatic latent image on an electrostatic latent image bearing member comprising an organic photosensitive member, said organic photosensitive member being multilayered and negatively chargeable;

(b) developing through a developing means said electrostatic latent image employing a toner to form a toner image;

(c) transferring the toner image to a recording medium;

(d) cleaning the electrostatic latent image bearing member by a cleaning means in contact with a surface of the electrostatic latent image bearing member to collect untransferred toner as waste toner thereon; and (e) fixing the toner image transferred to the recording medium, wherein said waste toner after collection is reused in a subsequent step (b) as a mixed toner comprising said collected waste toner and toner not yet used for developing the electrostatic latent image, wherein said toner comprises a binder resin, a colorant and a release agent, said binder resin having at least one peak in the region of a molecular weight from 2,000 to 50,000 and at least a peak or shoulder in the region of a molecular weight of not less than 100,000 in molecular weight distribution as measured by gel permeation chromatography, and said release agent having a methylene chain, a temperature of an endothermic peak in the range of 80° C. to 120° C. at the time of temperature rise in its DSC curve, an onset temperature of the endothermic peak in the range of 45° C. to 100° C., a weight average molecular weight (Mw) from 500 to 4,000, a number average molecular weight (Mn) from 500 to 1,300 and a value of Mw/Mn of not more than 3 in molecular weight distribution as measured by gel permeation chromatography.

2. The image forming method according to claim 1, wherein said binder resin comprises a vinyl resin.

3. The image forming method according to claim 2, wherein said binder resin comprises a vinyl resin cross-linked with a cross-linkable monomer.

4. The image forming method according to claim 3, wherein said cross-linkable monomer is contained in said vinyl resin in an amount of from 0.01 part by weight to 5 parts by weight based on 100 parts by weight of other monomers.

5. The image forming method according for claim 2, wherein said vinyl binder resin comprises a polymer or copolymer of vinyl monomers selected from the group consisting of styrene, an unsaturated monomers, an unsaturated polyene, a vinyl halide, a vinyl ester, a methacrylic ester, an acrylic ester, a vinyl ether, a vinyl ketone, an N-vinyl compound, vinyl naphthalene, and derivatives of styrene.

6. The image forming method according to claim 1, wherein said release agent has, in its molecular weight distribution measured by GPC, a weight average molecular weight (Mw) of from 800 to 3,600, a number average molecular weight (Mn) of from 600 to 1,000, and a value of Mw/Mn of not more than 2.

7. The image forming method according to claim 1, wherein said release agent has a softening point of 130° C. or below.

8. The image forming method according to claim 1, wherein said release agent has a density of 0.93 g/cm$^3$ or above at 25° C.

9. The image forming method according to claim 1, wherein said release agent has a density of 0.95 g/cm$^3$ or above at 25° C.

10. The image forming method according to claim 1, wherein said release agent has a penetration of 2.0 ($10^{-1}$ mm) or below at 25° C.

11. The image forming method according to claim 1, wherein said release agent has a penetration of 1.5 ($10^{-1}$ mm) or below at 25° C.

12. The image forming method according to claim 1, wherein said toner contains said release agent in an amount of 0.1 part by weight to 15 parts by weight based on 100 parts by weight of said binder resin.

13. The image forming method according to claim 1, wherein said toner contains said release agent in an amount of 0.5 part by weight to 10 parts by weight based on 100 parts by weight of said binder resin.

14. The image forming method according to claim 1, wherein said toner comprises a mixture of toner particles and a hydrophobic fine silica powder.

15. The image forming method according to claim 14, wherein said hydrophobic fine silica powder has a surface specific area of not less than 30 m$^2$/g.

16. The image forming method according to claim 14, wherein said hydrophobic fine silica powder has a surface specific area of 50 to 400 m$^2$/g.

17. The image forming method according to claim 1, wherein said toner comprises a magnetic toner containing a magnetic material as a colorant.

18. The image forming method according to claim 1, wherein said toner comprises a non-magnetic toner containing at least one of a pigment and a dye as a colorant.

19. The image forming method according to claim 18, wherein said non-magnetic toner is blended with a carrier and used as a two-component developer.

20. The image forming method according to claim 19, wherein said carrier is coated with at least one of a resin and a silicone compound.

21. The image forming method according to claim 1, wherein said toner collected is fed to said developing means via a hopper.

22. The image forming method according to claim 1, wherein said toner collected is directly fed to said developing means.

23. The image forming method according to claim 1, wherein said release agent is a saturated straight chain hydrocarbon or a saturated straight chain hydrocarbon having a functional group.

24. The image forming method according to claim 23, wherein said functional group is a member selected from the group consisting of a hydroxyl group, a carboxyl group, an amino group, an ester group and an amido group.

25. The image forming method according to claim 1, wherein said release agent is a saturated straight chain hydrocarbon or saturated straight chain hydrocarbon having a functional group and has a number average molecular weight (Mn) of from 500 to 1,300 as measured by gel permeation chromatography, and a value of Mw/Mn of not more than 2, wherein Mw is weight average molecular weight of said release agent.

* * * * *

UNITED STATES PATENT AND TRADEMARK OFFICE

CERTIFICATE OF CORRECTION

PATENT NO. : 6,632,577 B2
DATED : October 14, 2003
INVENTOR(S) : Yasutaka Akashi et al.

It is certified that error appears in the above-identified patent and that said Letters Patent is hereby corrected as shown below:

Column 2,
Line 42, "of" should be deleted.

Column 4,
Line 14, " $2x10^6$ This" should read -- $2x10^6$. This --; and
Line 56, "an" should read -- a --.

Column 7,
Line 29, "comprising;" should read -- comprising: --.

Column 8,
Line 29, "these;" should read -- these: --.

Column 9,
Line 23, "filters," should read -- filters --;
Line 39, "measurement." should read -- a measurement. --; and
Line 49, "" should read -- -- --.

Column 10,
Line 49, "dimethylvaleronitrile." should read -- dimethylvaleronitrile --.

Column 11,
Line 39, "variable amount, variable" should read -- a variable amount, --.

Column 12,
Line 9, "p-ethylstyrenee," should read -- p-ethylstyrene --; and
Line 10, "p-n-octystyrene" should read -- p-n-octylstyrene --.

Column 16,
Line 20, "held" should read -- held in -- and "in the" should be deleted.

UNITED STATES PATENT AND TRADEMARK OFFICE

CERTIFICATE OF CORRECTION

PATENT NO. : 6,632,577 B2
DATED : October 14, 2003
INVENTOR(S) : Yasutaka Akashi et al.

It is certified that error appears in the above-identified patent and that said Letters Patent is hereby corrected as shown below:

Column 18,
Line 5, "it it" should read -- it --.

Column 20,
Line 1, "teterafluoroborate" should read -- teterafluoroborate --; and
Line 12, " 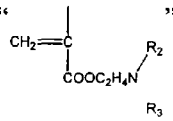 " should read -- 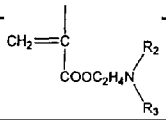 --.

Column 21,
Line 44, "preferably" should read -- be preferably --.

Column 22,
Line 29, "a-methylstyrene" should read -- α-methylstyrene --.

Column 25,
Line 20, "comprises;" should read -- comprises:--;
Line 32, "collected," should read -- collected --; and
Line 52, "tough" should read -- resistant --.

Column 28,
Line 66, "6" should read -- 5 --.

Column 32,
Line 44, "hexamethyldisialzane," should read -- hexamethyldisilazane, --.

Column 33, Table 2,
In Example 4, under the heading Release agent No. (parts), "Comparative Release Agent No. 1" should read -- No. 1 (4) --; and
In Comparative Example 4, under the heading Release agent No. (parts), "No. 1 (4)" should read -- Comparative Release Agent No. 1 --.

UNITED STATES PATENT AND TRADEMARK OFFICE

CERTIFICATE OF CORRECTION

PATENT NO. : 6,632,577 B2
DATED : October 14, 2003
INVENTOR(S) : Yasutaka Akashi et al.

It is certified that error appears in the above-identified patent and that said Letters Patent is hereby corrected as shown below:

Column 35,
Line 19, "on paper" should read -- of paper --.

Column 37,
Line 51, "monomers," should read -- monolefin, --.

Signed and Sealed this

Sixth Day of April, 2004

JON W. DUDAS
*Acting Director of the United States Patent and Trademark Office*